US010639222B2

(12) United States Patent
Krasnov et al.

(10) Patent No.: US 10,639,222 B2
(45) Date of Patent: May 5, 2020

(54) METHODS FOR CHANGING THE POSITION OF THE BODY THAT PROVIDES COMPLEX PHYSICAL PATIENT REHABILITATION AND A APPARATUSES FOR ITS REALIZATION

(71) Applicant: Sergey Krasnov, Nizhny Novgorod Region (RU)

(72) Inventors: Sergey Vasilevich Krasnov, Sarov (RU); Rupert Edward Robert Wilbraham, Moscow (RU); Lubomir Kupecz, Houston, TX (US); Alex Ignatiev, Houston, TX (US); Alexey Nikolaevich Ustsov, Sarov (RU); Victor Pavlovich Martyshkin, Sarov (RU); Anastasia Sergeevna Krasnova, Sarov (RU); Ekaterina Nikolaevna Maltseva, Sarov (RU); Leonid Vasilevich Goryachev, Sarov (RU); Vitaliy Yurievich Arapov, Sarov (RU); Konstantin Viktorovich Filatov, Sarov (RU)

(73) Assignee: Sergey Vasilevich Krasnov, Sarov (RU)

( * ) Notice: Subject to any disclaimer, the term of this patent is extended or adjusted under 35 U.S.C. 154(b) by 292 days.

(21) Appl. No.: 15/455,311

(22) Filed: Mar. 10, 2017

(65) Prior Publication Data

US 2018/0042800 A1 Feb. 15, 2018

Related U.S. Application Data

(60) Provisional application No. 62/306,330, filed on Mar. 10, 2016.

(51) Int. Cl.
*A61G 7/057* (2006.01)
*A61G 7/05* (2006.01)
(Continued)

(52) U.S. Cl.
CPC ..... *A61G 7/05769* (2013.01); *A47C 20/048* (2013.01); *A47C 27/083* (2013.01);
(Continued)

(58) Field of Classification Search
CPC .... A61G 7/001; A61G 7/057; A61G 7/05769; A61G 7/05776; A61G 13/1265; A47C 20/048; A47C 27/082; A47C 27/083
See application file for complete search history.

(56) References Cited

U.S. PATENT DOCUMENTS 3,978,530 A * 9/1976 Amarantos ..... A47C 20/048 5/615
4,488,322 A * 12/1984 Hunt ..... A47C 20/048 5/713
(Continued)

*Primary Examiner* — Nicholas F Polito
(74) *Attorney, Agent, or Firm* — Robert W. Strozier

(57) ABSTRACT

Methods and apparatuses for providing physical rehabilitative therapy for patients including a support surface of a number of parallel inflatable air sacs that are placed on multi-layered inflatable pneumatic levers made out of a strong hermetic material that are of different diameters and different lengths which are attached to longitudinal multi-layered inflatable side pneumatic levers that are all interconnected by flexible air tube connections to multi-layered inflatable pneumatic envelope levers which are all connected to a controlling apparatus to regulate the inflation and deflation of said sacs and pneumatic levers.

20 Claims, 25 Drawing Sheets

(51) Int. Cl.

| | |
|---|---|
| ***A47C 27/08*** | (2006.01) |
| ***A61G 7/018*** | (2006.01) |
| ***A61G 7/00*** | (2006.01) |
| ***A47C 20/04*** | (2006.01) |
| ***A61G 7/053*** | (2006.01) |

(52) U.S. Cl.

CPC ..... *A61G 7/001* (2013.01); *A61G 7/018* (2013.01); *A61G 7/0524* (2016.11); *A61G 7/0525* (2013.01); *A47C 27/082* (2013.01); *A61G 7/0536* (2013.01)

(56) References Cited

U.S. PATENT DOCUMENTS 4,527,298 A * 7/1985 Moulton ..... A61G 7/018 5/615
4,839,932 A * 6/1989 Williamson ..... A47C 20/048 5/615
4,941,221 A * 7/1990 Kanzler ..... A47C 20/048 5/607
5,966,762 A * 10/1999 Wu ..... A61G 7/05769 5/615
5,970,545 A * 10/1999 Garman ..... A47C 20/027 5/615
6,012,186 A * 1/2000 Soltani ..... A47C 20/048 5/613
2002/0027384 A1* 3/2002 Zur ..... A61G 5/1043 297/452.41
2003/0041378 A1* 3/2003 Davis ..... A47C 20/048 5/615
2007/0101504 A1* 5/2007 Gilchrest, Jr. ..... A61G 7/0504 5/706
2010/0154118 A1* 6/2010 Pearce ..... A47C 19/005 5/201
2011/0289691 A1* 12/2011 Lafleche ..... A61G 7/05761 5/710
2012/0222214 A1* 9/2012 Lachenbruch ..... A61G 7/001 5/81.1 R
2012/0297540 A1* 11/2012 Thomas ..... A61G 7/0507 5/424

* cited by examiner

METHODS FOR CHANGING THE POSITION OF THE BODY THAT PROVIDES COMPLEX PHYSICAL PATIENT REHABILITATION AND A APPARATUSES FOR ITS REALIZATION

RELATED APPLICATIONS

This application claims the benefit of and priority to U.S. Provisional Patent Application Ser. No. 62/306,330 filed Mar. 10, 2016 (10 Mar. 2016) (10.03.2016), incorporated herein by reference.

BACKGROUND OF THE INVENTION

1. Field of the Invention

Embodiments of the present invention relates to apparatuses and methods of providing physical rehabilitative therapy for patients including reanimation, physical rehabilitation, and/or treatment of patients, who are either fully immobile or partially immobile. The methods and apparatuses may be employed to treat a wide variety of medical conditions and are suitable for use in specialized medical institutions, at home, or in the field.

More particularly, embodiments of the present invention relates to apparatuses and methods of providing physical rehabilitative therapy for patients including reanimation, physical rehabilitation and treatment of patients, where the apparatuses includes a base subsystem or assembly, an inflatable subsystem or assembly including a plurality of inflatable members, an inflation control subsystem or assembly including a processing unit and a plurality of valves, gas controllers, and a pump or a plurality of pumps under control of the processing unit, and optionally an adjustment subsystem or assembly comprising a plurality of adjustment members that permit the apparatus to be conformed to a patient prior to use and where the inflation control subsystem is capable of controlling an inflation pressure in each inflatable member independently.

2. Description of the Related Art

Whilst modern methods of intensive care have greatly reduced instances of mortality from traumatic shock deaths and severe illness from subsequent medical decubitus (long term bed bound) complications such as pressure ulcers, contractures, bronchial pneumonia etc. have not decreased to the same degree. Existing world medical practices in combating decubitus complications involves medical devices that vary in both complexity and price. The basic principles that many such devices employ to combat the onset of pressure ulcers are the periodic changing of the support surfaces of the body of the patient and/or pressure distribution to reduce soft tissue ischemia. Such devices, however, while reducing soft tissue ischemia, the devices do little to prevent or counteract other serious decubitus complications such as pneumonia/atelectasis, disuse osteoporosis, impaired digestion and excretion, muscle atrophy, contractures, poorly functioning metabolism, hormonal system and impaired blood and lymph circulation. One such device and methods for using the devices may be found in U.S. Pat. No. 5,586,346.

While other beds for assisting patients have been developed and used in hospitals, homes, and in the field, there is still a need in the art for new and novel bed apparatuses for patients capable of reducing bed sores and muscle atrophy and assisting in patient reanimation, physical rehabilitation, and treatment.

SUMMARY OF THE INVENTION

Embodiments of this invention provide apparatuses adapted to change a position of a body, where the apparatuses include: (a) an inflatable subsystem or assembly including a plurality of inflatable members, (b) an inflation control subsystem or assembly including at least one processing unit and a plurality of valves, gas controllers, and a pump or a plurality of pumps under control of the processing unit (c) a base subsystem or assembly including a rigid corrugated plastic base through which air hoses run from the main pump-controller to the multiple parallel inflatable air sacs, and (d) optionally, an adjustment subsystem or assembly comprising one or a plurality of adjustment members. The inflation control subsystem/assembly is adapted to change an inflation pressure in each of the inflatable members allowing the apparatuses to change, alter, and/or redistribute pressure on different parts of a patient's body including an upper spine, legs, right trunk side, left trunk side, arms, neck, head, etc. The apparatuses may also be used to move the body, body parts, and/or body structures into various positions and to move the body, body parts, and/or body structures along various trajectories by changing an air pressure distribution of the inflatable members. The trajectories may include, without limitation, raising and turning the head, raising and turning the chest, turning and lifting the whole back, raising and lifting the lumbar, raising and lifting the pelvis, raising and bending the legs together at the knee or at the hip and raising the legs separately at the knee or the hip in a "bicycle" fashion for accomplishing specific treatments or treatment protocols, changing the air pressure distribution in the inflatable members to accomplish specific treatments or treatment protocols for other body parts, etc. These body movements are accomplished while the patient is situated on the apparatus. In certain embodiments, the apparatuses also include an adjustment subsystem or an adjustment assembly comprising a plurality of adjustment members that permit the apparatus to be conformed to each patient.

Embodiments of this invention provide methods of changing a position of a body using the bed apparatuses of this invention, where the methods include positions a patient on a bed apparatus including: (a) an inflatable subsystem or assembly including a plurality of inflatable members, (b) an inflation control subsystem or assembly including at least one processing unit and a plurality of valves, gas controllers, and a pump or a plurality of pumps under control of the processing unit, (c) a base subsystem or assembly including a rigid corrugated plastic base through which air hoses run from the main pump-controller to the multiple parallel inflatable air sacs, and (d) optionally, an adjustment subsystem or assembly comprising one or a plurality of adjustment members. The methods also include adjusting a pressure in one, some or all of the inflatable members to achieve a desire pressure distribution across the body. In certain embodiments, the adjusting system includes adjusting the pressure in one, some or all of the inflatable members to redistribute pressure on a patient's upper spine, legs, right and left sides, head, neck, arms, shoulders, etc. In other embodiments, the methods also include adjusting the pressure in one, some or all of the inflatable members intermittently, randomly, semi-periodically, periodically, or according to a schedule, regime, regiment, or protocol. In other embodiments, the methods include the step of, prior to a patient being laid down on the apparatus, adjusting or adapting the apparatus to the patient's body proportions using an adjustable subsystem/assembly. Once the patient is lying on the apparatus, air pressure is introduced into the inflatable members and regulated so as to increase and/or decrease pressure on different parts of the body during selected time frames and during patient body positioning actions. The methods may also include the step of moving the body into various trajectories such as raising and turning the head, raising and turning the chest, turning and lifting the whole back, raising and lifting the lumbar, raising and lifting the pelvis, raising and bending the legs together at the knee or at the hip and in one embodiment of the invention raising the legs separately at the knee or the hip in a "bicycle" fashion for accomplishing specific treatment of other parts of the body during times situated on the apparatus by changing air pressure in the inflatable members so that each movement is accomplished.

BRIEF DESCRIPTION OF THE DRAWINGS

The invention can be better understood with reference to the following detailed description together with the appended illustrative drawings in which like elements are numbered the same.

Potential Patient Positions

FIGS. 13-24 illustrate some of the positions into which the apparatus 100 may be adjusted to situate a patient in various positions.

Figure 13:
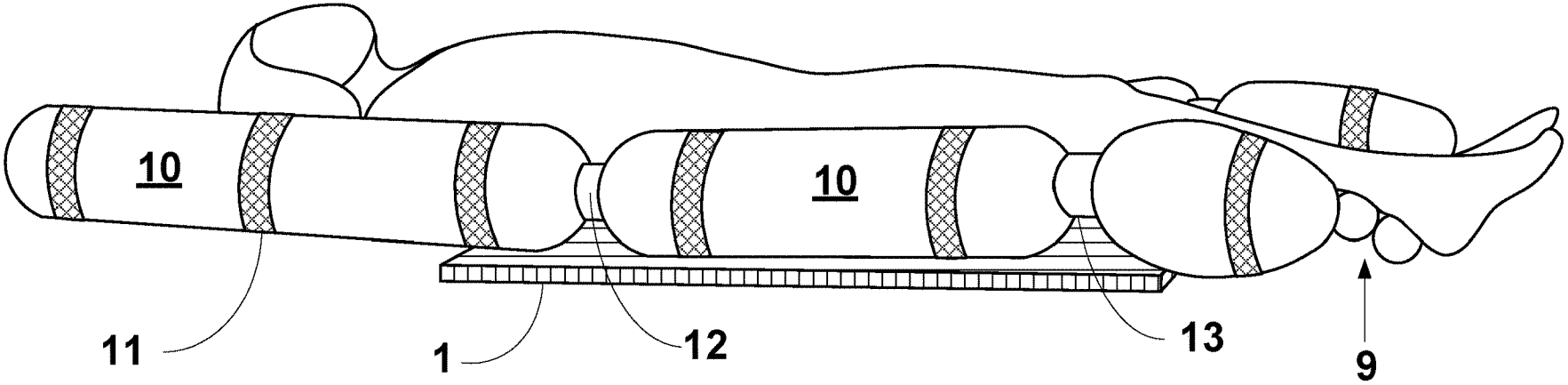

FIG. 13 depicts the patient in a fully horizontal position.

Figure 14:
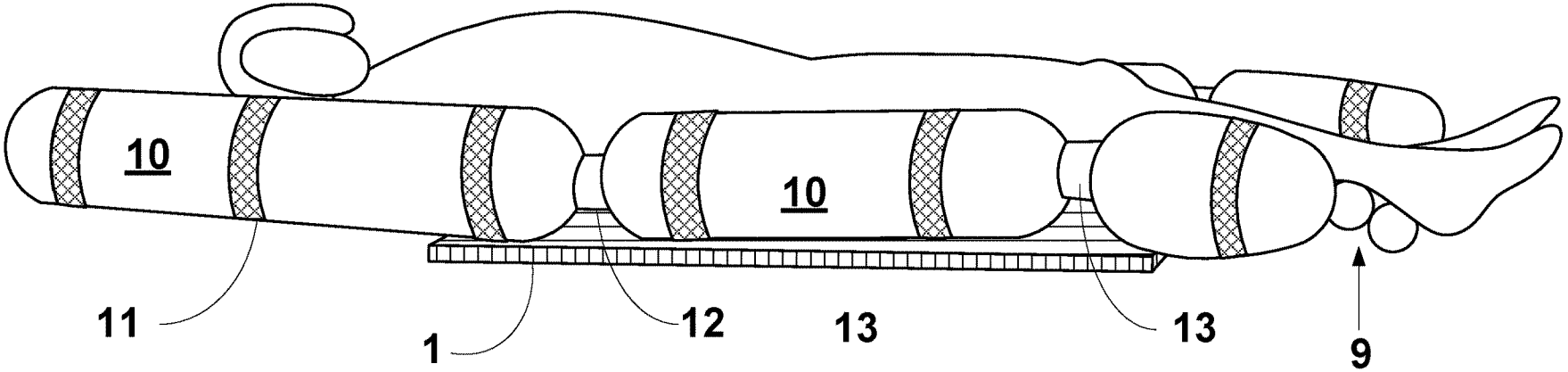

FIG. 14 depicts the patient in a fully horizontal position with the patient's head turned to the right.

Figure 15:
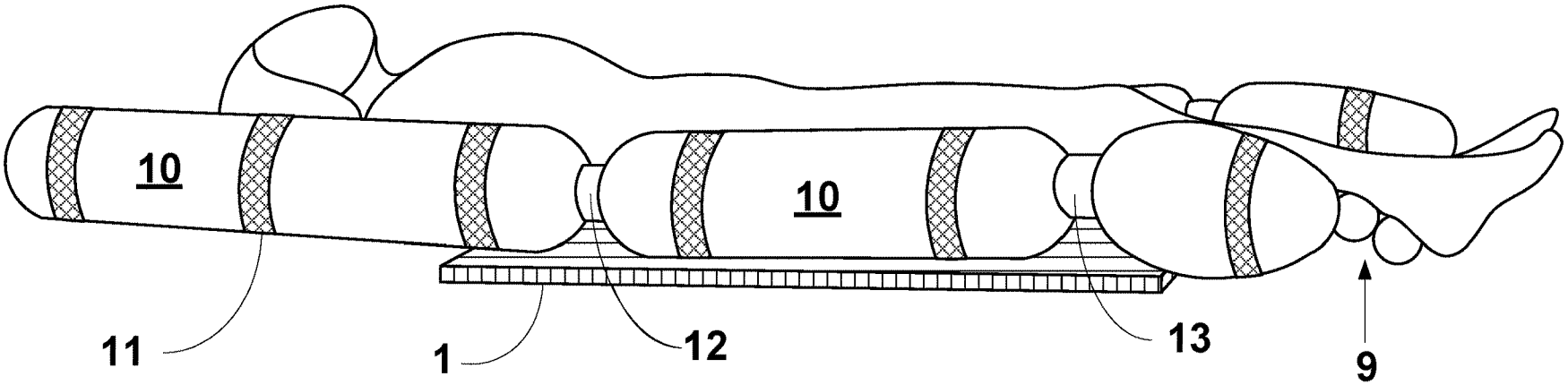

FIG. 15 depicts the patient in a fully horizontal position with the patient's chest raised.

Figure 16:
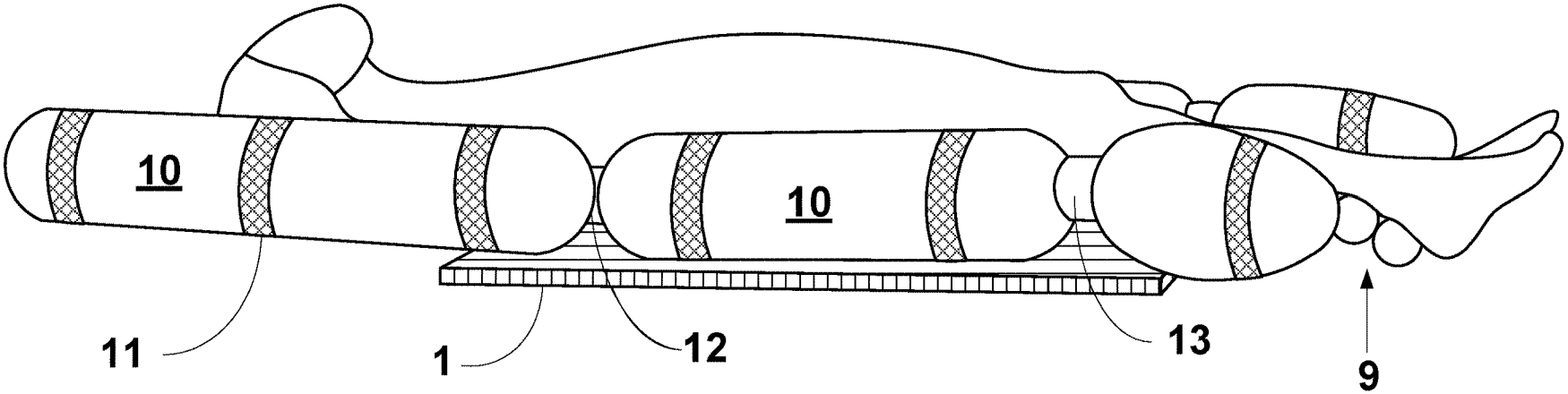

FIG. 16 depicts the patient in a horizontal position with pelvis region raised.

Figure 17:
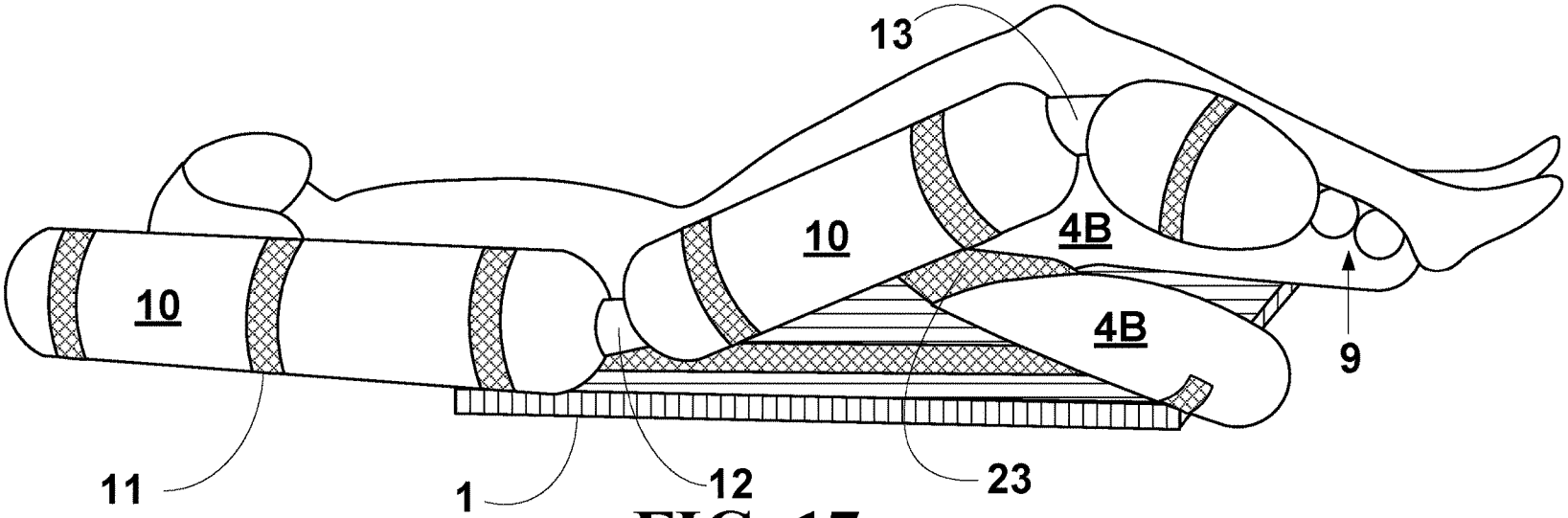

FIG. 17 depicts the patient in a horizontal position with raised legs and bended knees.

Figure 18:
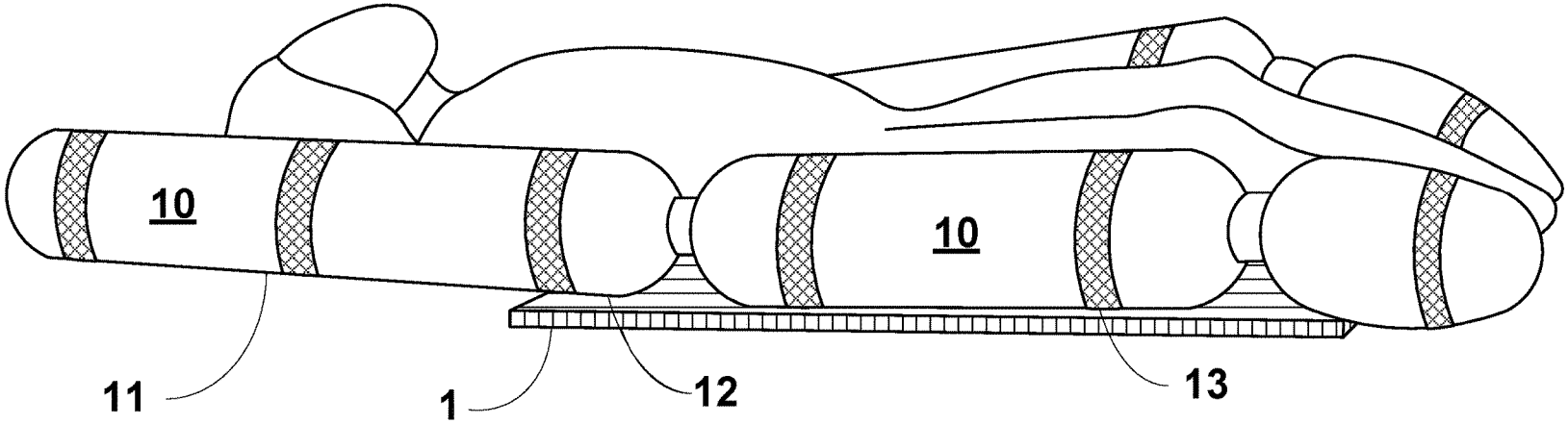

FIG. 18 depicts the patient in a horizontal position with slightly raised and bended knees.

Figure 19:
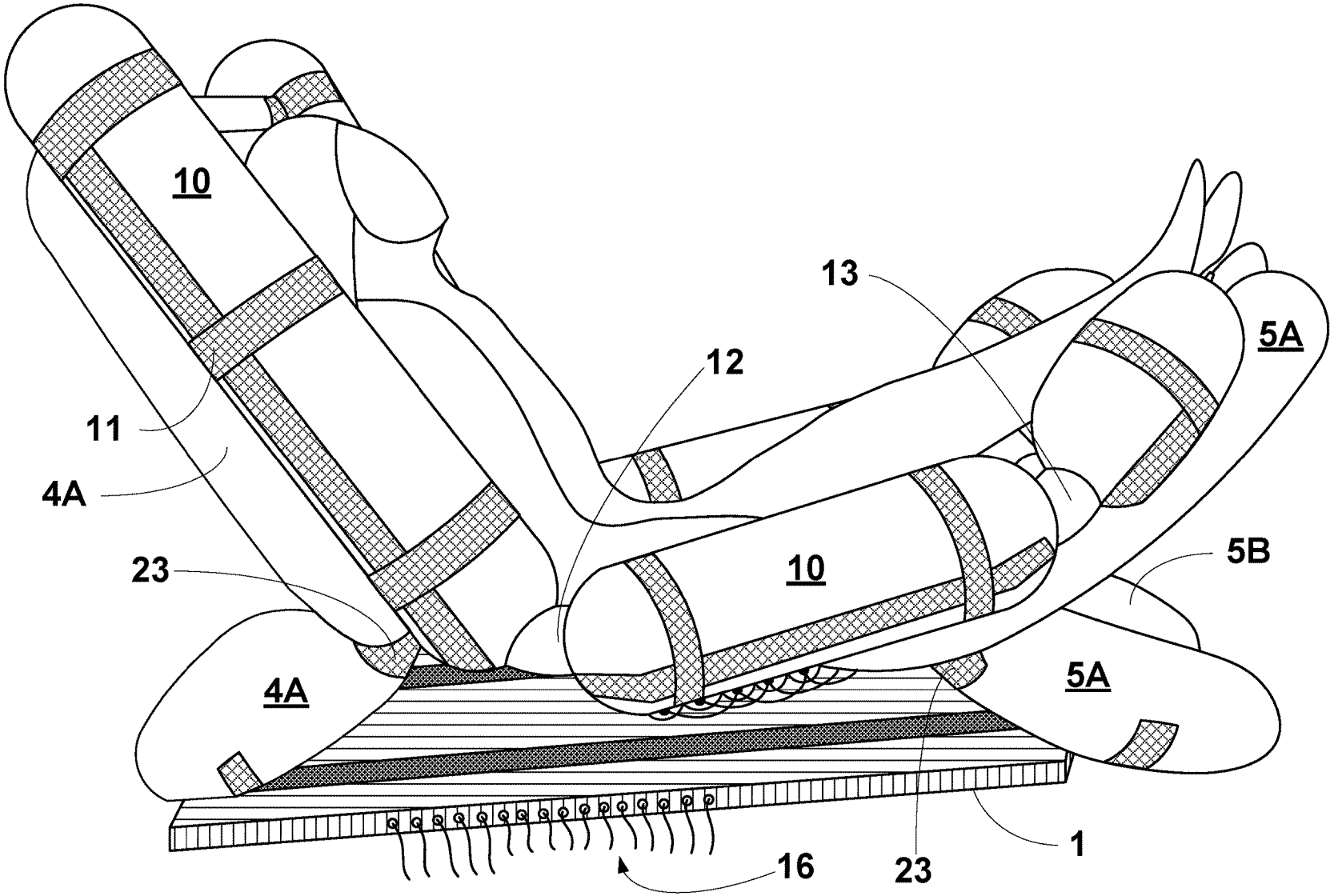

FIG. 19 depicts the patient in a raised upper body and raised legs position.

Figure 20:
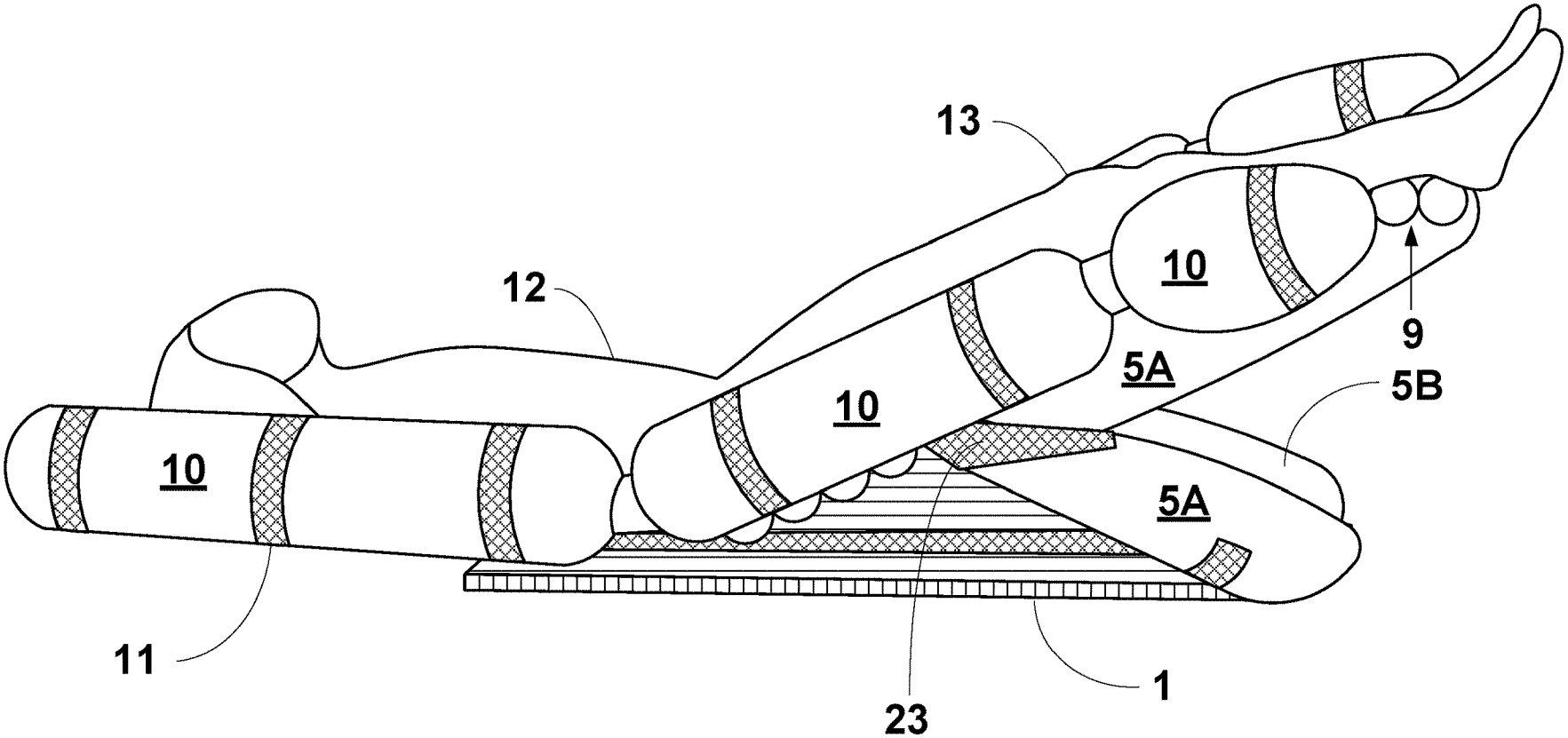

FIG. 20 depicts the patient in a horizontal position with the legs lifted together.

Figure 21:
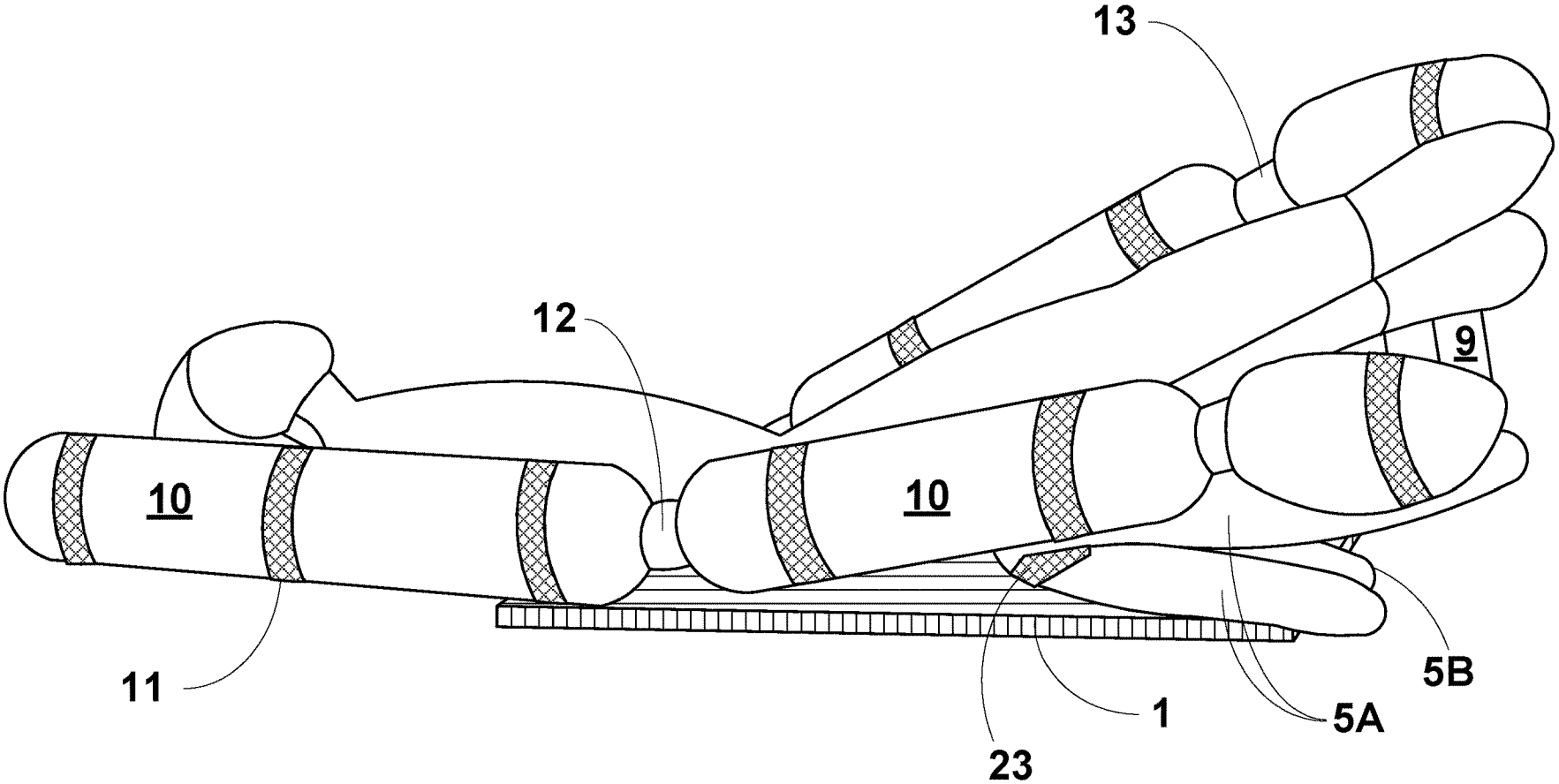

FIG. 21 depicts the patient in a horizontal position with the legs lifted and turned to the right.

Figure 22:
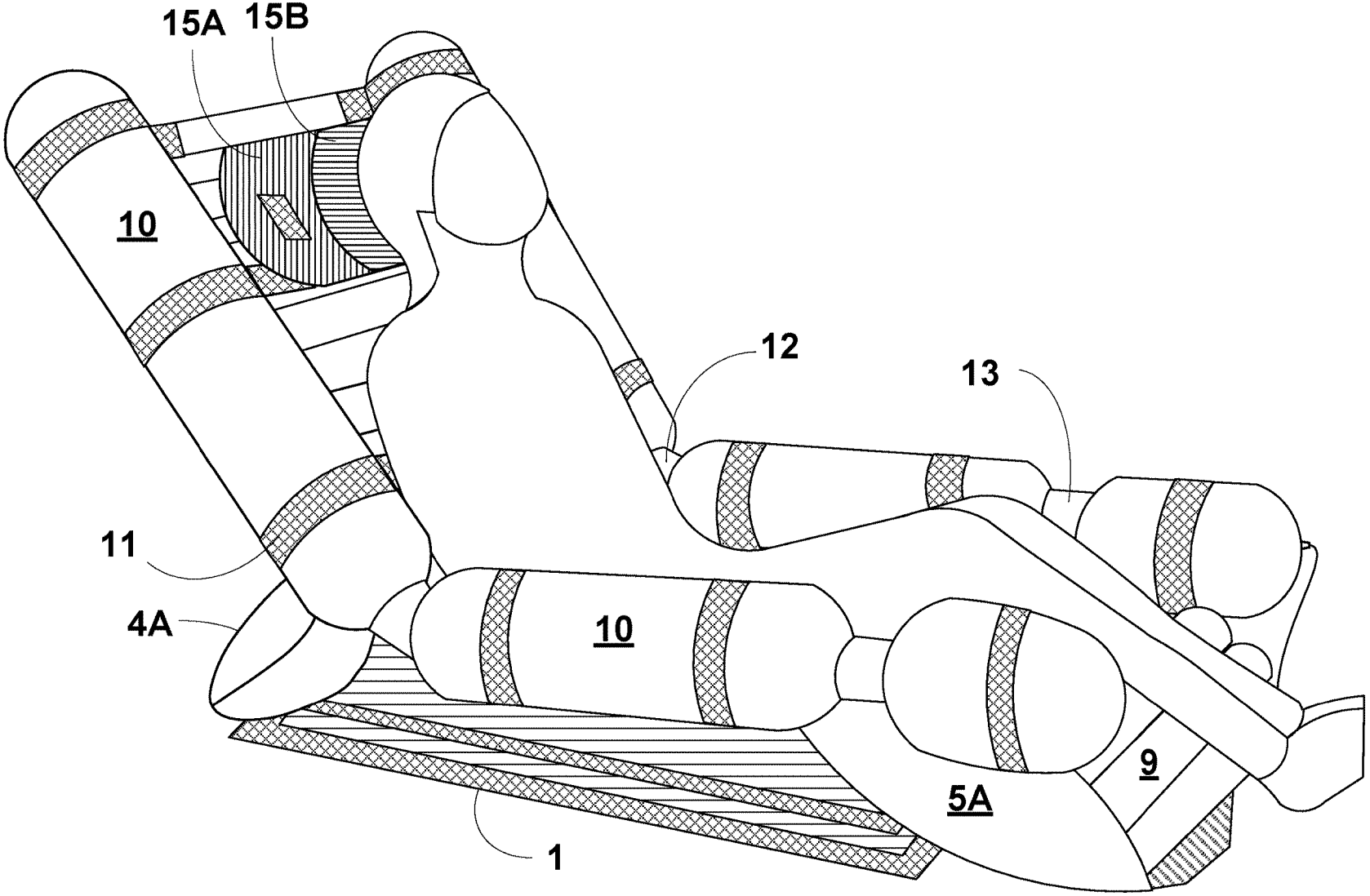

FIG. 22 depicts the patient in a seated posture with upper body raised and knees bent.

Figure 23:
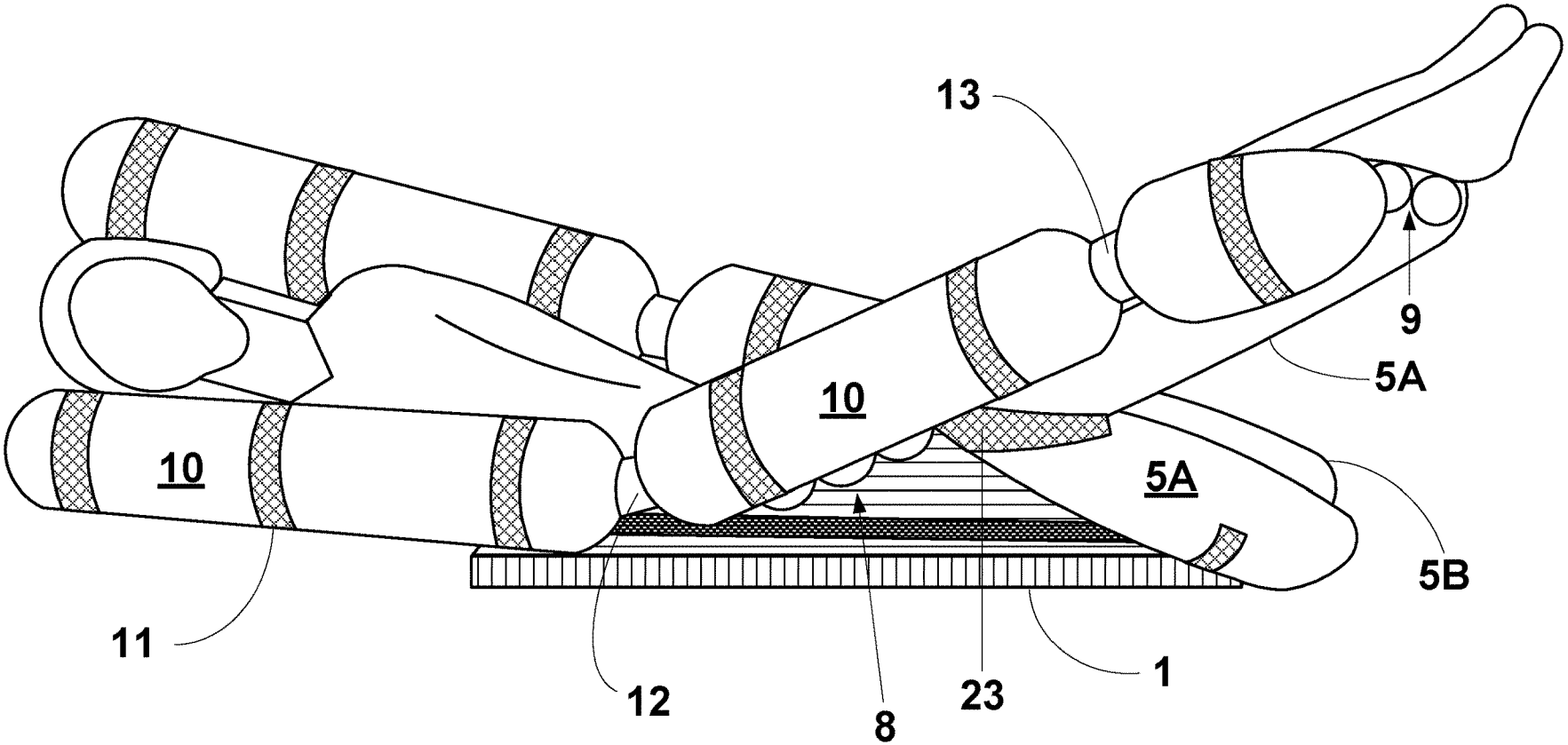

FIG. 23 depicts the patient in a horizontal position with the upper body twisted to the right and the legs twisted to the left.

Figure 24:
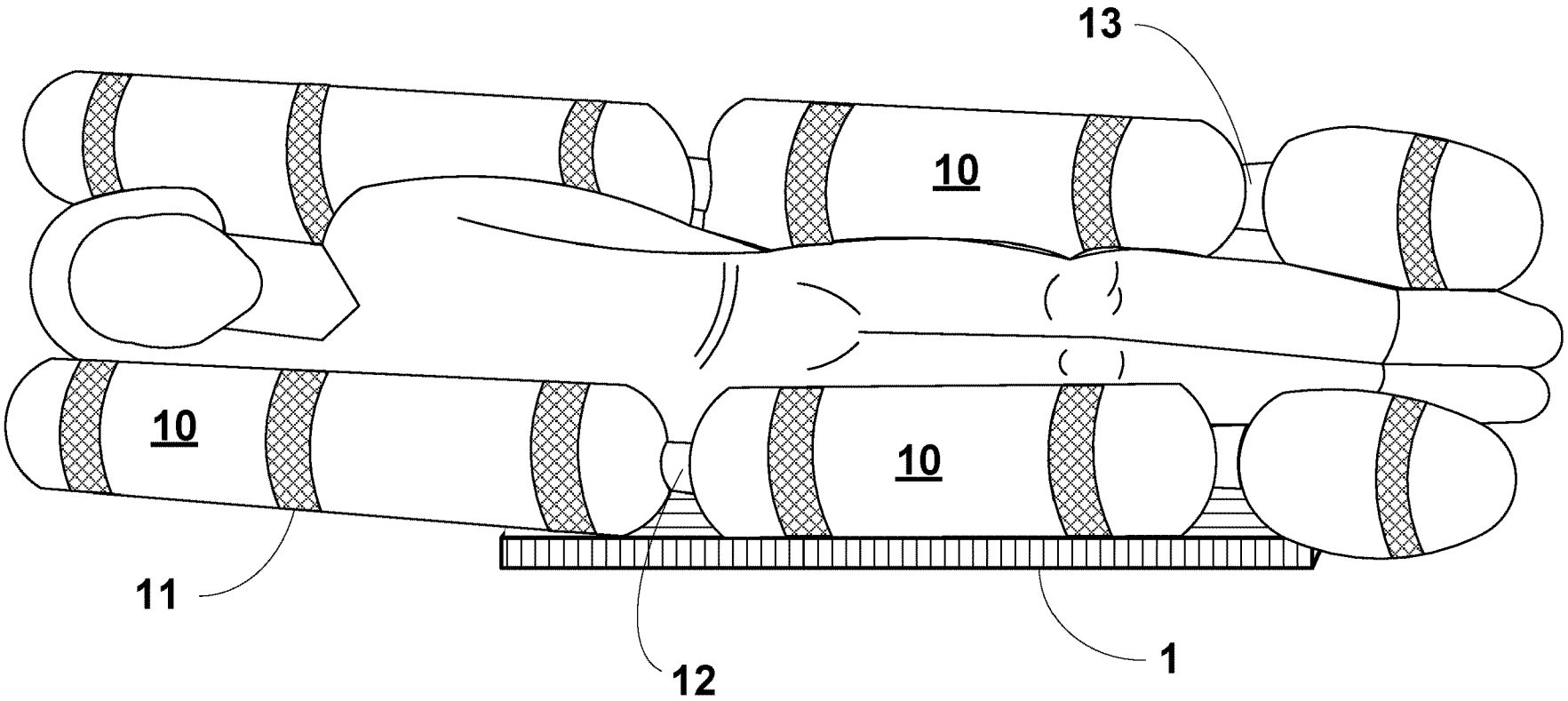

FIG. 24 depicts the patient in a horizontal position with the whole body turned to the right.

Remote Control Apparatus

Figure 25:
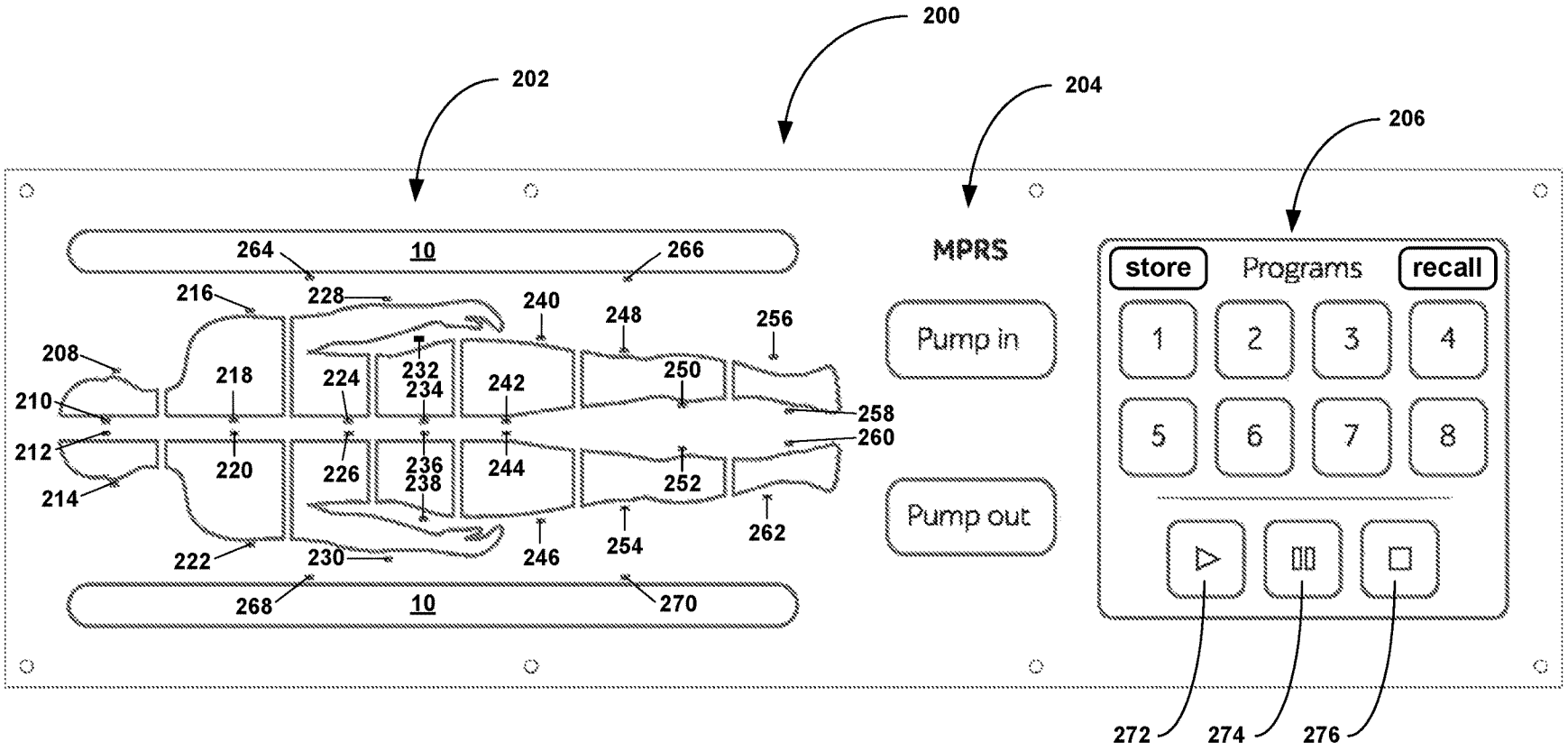

FIG. 25 depicts an embodiment of a remote control unit for controlling and programming the bed apparatus 100 and may be in wired or wireless communication with the processing unit associated with the control assembly.

DETAILED DESCRIPTION OF THE INVENTION

The inventors have found that a physical rehabilitative and therapeutic bed apparatus may be constructed that includes an inflatable subsystem or an inflatable assembly including a plurality of inflatable members and an inflation control subsystem or an inflation control assembly including a processing unit and a plurality of valves, gas controllers, and a pump or a plurality of pumps under control of the processing unit, where the inflatable members may be independently, collectively in whole or part, semi-periodically, periodically, intermittently, and/or in accord with a schedule or protocol inflated and/or deflated to any desired pressure by the inflation control subsystem/assembly. The inflatable subsystem/assembly under the control of the inflation control subsystem/assembly allows the apparatuses of this invention to actively, periodically, intermittently, or randomly reposition bed ridden patients or to reposition a patient on the apparatuses of this invention according to a repositioning, rehabilitative, and therapeutically program, schedule, or protocol.

The inventors have also found that aligning the patient correctly on the apparatus aids in maximizing a beneficial impact of a given treatment program, schedule, or protocol. Thus, the apparatuses may also include an adjustment subsystem or an adjustable assembly comprising a plurality of adjustment members. Once the apparatuses are adjusted to conform to a particular patient, the apparatuses allow for the adjustment of the pressure distribution in the inflatable members of the inflation subsystem/assembly to change the pressure on different sections of the body. By adjusting the pressure distribution according to a program, schedule, or protocol allows a body laying on the bed apparatuses to be moved along various trajectories and in doing so provides a highly rehabilitative effect.

The inventors have also found that the apparatuses and methods provide a wide range of movement exercises and body positioning exercises for the key areas of a patient's muscular-skeletal system by the application of pressure to the body so as to move it in three dimensions and in various combinations. The movements may occur in either a lying position, a sitting position, or both. The movements may include, without limitation, turning the legs and spine, lifting the legs to any angle, turning the legs and spine in different directions, lifting and turning the body at the pelvis, lifting and turning the body at the waist as well as other combinations and to provide a massage effect. The all pneumatic construction of the apparatus and the use of elastic fixings or attachment member to connect its multiple parts allow the apparatus to contour itself to the patient's body form. This conformity to the body structure coupled with the smooth interaction and movement of the pneumatic levers or lever members assists in changing the position of the patient with a wide range of movement and minimizes damage to the soft tissue of the patient through friction and shear.

Embodiments of this disclosure relate broadly to methods of changing a position of a body comprising positioning a patient on a bed apparatus including: (a) an inflatable assembly comprising a plurality of inflatable members including at least one plurality of parallel sacs, at least two upper body lever members and at least two lower body lever members, (b) an inflation control assembly including at least one processing unit and a plurality of electrically controlled valves, a plurality of electrically controlled gas controllers, a plurality of fittings, a electrically controlled pump or a plurality of electrically controlled pumps, where the valves, gas controllers, pump or pumps are under control of the processing unit, and (c) a base assembly including a rigid corrugated plastic base through which air hoses run from the control assembly to the inflatable members. The methods also include adjusting a pressure in one, some, or all of the inflatable members via the inflation control assembly to achieve a pressure distribution across a body of a patient positioned on the apparatus resulting in a patient position or orientation on the bed apparatus. In certain embodiments, the adjusting step comprises: adjusting the pressure in one, some or all of the inflatable members to distribute pressure on a patient's spine, legs, right side, left side, head, neck, arms, and/or shoulders. In other embodiments, the adjusting step comprises: adjusting the pressure in one, some or all of the inflatable members intermittently, randomly, semi-periodically, periodically, or according to a programmed sequence, schedule, regime, regiment, or protocol. In other embodiments, the methods also include prior to the patient being positioned on the apparatus, adjusting positions of some inflatable members and/or adjusting adjustable members associated with some of the inflatable members to adapt the apparatus to the patient's body proportions and to establish pivot or fulcrum points. In other embodiments, the adjusting step comprises: increasing and/or decreasing pressure in one, some or all of the inflatable members to change a patient position. In other embodiments, the patient positions are selected from the group consisting of a raised head position, a turned head position, a raised chest position, a turned chest position, a raised upper back position, a turned upper back position, a raised lower back or lumbar position, a turned lower back or lumbar position, a raised whole back position, a turned whole back position, a raised pelvis position, a turned pelvis positions, a raises leg position, a turn leg position, a raised legs position, a turned legs position, a bent leg position, a turned bent leg position, a bent legs position, a turn bent legs position, and mixtures or combinations of the positions. In other embodiments, the adjusting step comprises: adjusting the pressure in one, some or all of the inflatable members according to a programmed sequence. In other embodiments, the programmed sequence include moving the patient along a trajectory. In other embodiments, the trajectory is selected from the group consisting of raising and turning the head, raising and turning the chest, turning and lifting the whole back, raising and turning the upper back, raising and lifting the lumbar or lower back, raising and lifting the pelvis, raising and bending the legs together at the knee or at the hip, raising and bending each leg separately at the knee or at the hip, and mixtures or combinations thereof.

Embodiments of this disclosure relate broadly to apparatuses including: (a) an inflatable assembly comprising a plurality of inflatable members including at least one plurality of parallel sacs, at least two upper body lever members and at least two lower body lever members, (b) an inflation control assembly including at least one processing unit and a plurality of electrically controlled valves, a plurality of electrically controlled gas controllers, a plurality of fittings, a electrically controlled pump or a plurality of electrically controlled pumps, where the valves, gas controllers, pump or pumps are under control of the processing unit, and (c) a base assembly including a rigid corrugated plastic base through which air hoses run from the control assembly to the inflatable members. In certain embodiments, the control assembly further includes a power supply. In other embodiments, the control assembly further includes: a pressure control manifold incorporating the electrically controlled valves, the electrically controlled gas controllers, and the fittings, wherein the hoses include tubing fittings designed to detachably engage the control manifold fitting. In other embodiments, the control assembly further includes: a pressure control manifold incorporating the electrically controlled valves, the electrically controlled gas controllers, and the fittings, and an output manifold including tubing fittings and internal tubing interconnecting the control manifold fittings to the tubing fittings, wherein the hoses include tubing fittings designed to detachably engage the output manifold fitting. In other embodiments, the control assembly further includes: a control and/or programming panel. The panel includes: a body section having: a plurality of light emitting diodes and/or touch sensitive areas associated with an equal plurality of body locations, a pressure control section having: a pump in control button and/or touch sensitive area, and a pump out control button and/or a touch sensitive area, and a programming section having: number buttons and/or touch sensitive areas, control buttons and/or touch sensitive areas, a store button and/or touch sensitive area, a recall button and/or touch sensitive area, a play button and/or touch sensitive area, a pause button and/or touch sensitive area, a stop button and/or touch sensitive area, wherein the inflation control assembly is adapted to adjust a pressure in one, some, or all of the inflatable members to achieve a pressure distribution across a body of a patient positioned on the apparatus resulting in a patient position or orientation and wherein the control panel is adapted to enter a programmed sequence of pressure changes, to store a programmed sequence, to recall a programmed sequence, to play a programmed sequence, to pause a programmed sequence, or to stop programmed sequence.

In certain embodiments, the apparatus may also include an outer shell of elastic material that covers all or a portion of the inflatable assembly. In certain embodiments, the shell cover the entire inflatable assembly and is attached to the apparatus via hook and loop fastening members or fixings disposed on edges of the shell. In other embodiments, the shell covers only the body sacs or the body and the leg sacs again via hook and loop fastening members or fixings disposed on edges of the shell. The parallel inflatable sacs are positioned on top of multi layered pneumatic lever members that are detactably attached to and positional adjustable on a rigid corrugated plastic base through which various flexible plastic air hoses run from a main pump-controller to the inflatable air sacs, pneumatic lever members, and multi-layered longitudinal pneumatic inflatable side lever members. The side lever member may comprise long tubes made of strong hermetic material. The apparatus may also include adjustment members distributed along a length of the side lever members so that the apparatus may be adjusted to accommodate different patient especially at the hip and knee positions.

The apparatuses are designed so that a patient may be moved in three dimensions intermittently, semi-periodically, periodically, or according to a protocol, schedule, or routine. The apparatuses allow patients to be positioned and repositioned in various ways so that the patient may assume different lying and sitting positions. The apparatuses also may be adjusted to turn a patient's legs and twist about a patient's spine, to lift a patient's legs at any angle, to turn a patient's legs and spine in different directions, to lift and turn a patient's body at the pelvis, to lift and turn a patient's body at the waist, to provide a massage effect, and/or to provide an exercise effect.

The fully pneumatic construction of the apparatus and the use of elastic fittings to connect the parallel inflatable sacs with one and other and with the pneumatic lever members and the base allows the apparatus to contour itself to the patient's body form. In certain embodiments, the apparatus also include adjustment members to adjust the apparatus to each patient so that the hips and knees may be moved. The pneumatic lever members combined with the sacs permit smooth interaction and movement to change a position of the patient. These changes allow a wide range of movements to be performed minimizing damage to soft tissue to a patient through friction and shear.

Embodiments of this invention broadly relate to methods of changing a position of a body placed on a bed apparatus of this invention via a redistribution of air pressure in one, some, or all of the inflatable members of the inflation assembly. Such pressure redistributions may be used to change a position of an upper spine, a lower spine, legs, right and left sides of the trunk, neck, head, etc. In certain embodiments, the methods include, prior to a patient being placed on the apparatus, adapting the apparatus to a patient's body proportions using an adjustable assembly including adjustment member. Once the patient is placed on the apparatus, the methods include introducing air pressure into one, some, or all of the inflatable members of the inflation assembly to achieve a desired body configuration or orientation or position. The method also include adjusting and/or regulating a pressure in one, some, or all of the inflatable members so as to increase and decrease pressure on different body parts intermittently, semi-periodically, periodically, according to a schedule, regime, regiment, or protocol. The methods may also include adjusting and/or regulating a pressure in one, some, or all of the inflatable members over a time frame or period to invoke a patient body positioning activity schedule, regime, regiment, or protocol. The methods may also include treating body parts by adjusting and/or regulating a pressure in one, some, or all of the inflatable members to move the body into one or a plurality (one or more) trajectories, where the trajectories include, without limitation, raising and turning the head, raising and turning the chest, turning and lifting the whole back, raising and lifting the lumbar, raising and lifting the pelvis, raising and bending the legs together at the knee or at the hip, etc. The methods may include adjusting and/or regulating a pressure in one, some, or all of the inflatable members to raise and lower the legs separately at the knees and/or the hips to simulate a "bicycle" type action.

The apparatus is straightforward to manufacture and is designed for use in hospitals, nursing centers, rehabilitation centers, at home, or in the field and may be powered by an source of electric power including electricity from the electrical grid (hospitals, centers, homes, etc.), electrical power from generators, or electric power from batteries or any other source of electric power. The apparatuses may be controlled manually through a controller or wirelessly through a computer in communication with the inflation control assembly, where the communication may be over an intranet or an internet using communication hardware and software. The apparatuses may also include software that allows complex movement programs to be formulated, stored, and activated. In certain embodiments, the software may be voice activated and controlled.

Aligning the patient correctly on the apparatus is necessary for the maximal beneficial impact of a given treatment program. The apparatus allows for the introduction of pressure to different regions of the body, which when regulated moves the body into different positions and/or trajectories to provide a rehabilitative effect.

In certain embodiments, the methods of this invention relate to changing a position of a body by applying differential pressure to one or more body regions so as to move the body in three dimensions randomly, intermittently, semi-periodically, periodically, or according to a regiment, regime, protocol or schedule. In particular, the pressure applying step permits the body position to be changed in a lying position, a sitting position, or both. Thus, the methods may change pressure on the body to turn the legs and spine, lift the legs to any angle, turn the legs and spine in different directions, lift and turn the body at the pelvis, lift and turn the body at the waist, or moving the body in a sequence to provide a massage effect. Such patient specific movement combinations may be programmed directly into the processing unit of the apparatus control assembly or via a remote control computer software interface.

In other embodiments, the inflatable subsystem or assembly of the apparatuses of this invention for changing a position of a body comprises a support surface comprising a plurality of parallel inflatable air sacs. The parallel inflatable air sacs are deposed or placed on a plurality of multi-layered inflatable pneumatic levers or lever members. These lever members are attached to longitudinal multi-layered inflatable side pneumatic levers or lever members disposed down lateral edges of the air sacs. The inflatable assembly also includes a plurality of multi-layered inflatable pneumatic envelope levers or lever members. The air sacs and lever members are connected to the inflation control assembly, which regulates an inflation pressure (inflates or deflates) in the sacs and lever members. Certain of the multi-layered pneumatic levers or lever members comprise tubes of a cigar or cylindrical shape. Other lever members include a folding members allowing the member to fold back on itself at a location along its lengths (i.e., a location in their longitudinal direction). The folding member comprises a hook and loop strap encircling the member at the fold location. The member is anchored at one end to the base, to other inflatable members by the folding member and at it other end to other inflatable members. The hook and loop folding member or strap becomes a fulcrum and hinge for the pneumatic lever, which operates through the introduction of air into the lever member causing the member to inflate so that an upper portion (portion above the strap) lifts and arcs upwards about the hook and loop strap hinge point, while the lower portion (portion below the strap) supports the upper portion. When air is pumped out of the lever member, the upper portion folds over the lower portion and arcs back down as a lever arm around the same hook and loop strap hinge point. These levers function to move an upper body of the patient, while other move the legs and lower body of the patient into different positions or along desired trajectories, The pneumatic levers are made out of a strong hermetic material and may have the same or different size and shape different diameters or widths and/or lengths. The hermetic material layers give the levers (generally tubular) added rigidity and balance. The levers may also includes different inflatable sections that may be inflated and deflated to give added functionality to the levers. In certain embodiments, the lever is constructed to allow the lever to lift the knees of the patient without lifting the whole leg. In other embodiments, the lever member is constructed to lift a desired area of the patient's back without having to lift the whole upper body. In other embodiments, the levers are combined into pairs that are placed at optimal positions below the patient symmetrically on either side of the longitudinal center line.

Other pneumatic levers take the form of two or more inflatable envelopes of different sizes and/or shapes constructed of a strong hermetic material. These envelopes are joined and overlap one another. When all of the envelopes are inflated simultaneously, the lever member raise evenly and lift the body area of the patient under which they are located in an upwards direction. When the envelopes are inflated and deflated in designated and controlled sequences, they may move the body area of the patient under which they are located in different sideways and forward trajectories. Such multi-layered pneumatic levers are used to lift and turn the head and neck, the thoracic spine, the pelvis or other chosen body areas, etc. Again, these pneumatic levers are constructed out ofhermetic material layers giving the levers added rigidity and balance. Certain layers may comprise additional air tubes or sections made of hermetic material that may be inflated and deflated so as to give added functionality to the pneumatic levers.

All of the inflatable members sacs or levers are connected by flexible supply tubes or conduits to the control assembly and proceed from the inflatable member into and through the base to the control assembly that include one or more pumps and valves and controllers so that the pressure in each inflatable member may be controlled. Of course, the control assembly may be configured to control certain members collectively (all receiving the same air pressure), but the control assembly is capable of independently adjusting the pressure in each inflatable member. In this way, the pressure imparted to different portions of a body may be independently controlled to allow a body to be positioned in a number of different positions and/or to allow the body to undergo movement according to a trajectory and/or to allow the body to cycle through different positions or trajectories according to a schedule, regime, regiment, sequence or protocol.

The apparatuses may also include an outer upper covering shell of an elastic material that covers an entire longitudinal and transverse upper region of the apparatuses and which is connected to the parallel inflatable sacs below their upper surface by means of hook and loop attachments or fixings. The parallel inflatable sacs are positioned on top of the multi layered pneumatic levers that are fixed and position adjustable on the rigid corrugated plastic base through which air hoses or conduits run from the control assembly to the parallel inflatable air sacs, pneumatic levers, and multi-layered longitudinal pneumatic inflatable side levers. The longitudinal pneumatic inflatable side levers comprises long tubes made of strong hermetic material that may have their diameter adjusted at points along their lengths so that the apparatuses may be conformed to a patient's hip and knee joints for improved therapeutic movement.

In other embodiments, the apparatuses of this invention includes multiple identical parallel inflatable sacs, multi layered pneumatic levers, multi-layered longitudinal pneumatic inflatable side levers and a base all connected to one symmetrically along a longitudinal center axis by means of elastic hook and loop fixing tape connectors and furthermore the multiple identical and parallel inflatable sacs are arranged and fixed on parallel hook and loop fixing strips. The use of hook and loop fixings on the apparatus allows for easy adjustment, assembly and disassembly.

The fully pneumatic construction of the apparatuses of this invention and the use of elastic fittings to connect the multiple identical inflatable parallel sacs to each other and to all of the levers and the base in cooperation with the adjustment members allows the apparatuses of this invention to be conformed to a patient's body structure. The conformity to a body structure coupled with the smooth interaction and movement of the pneumatic levers assists in changing the position of the patient with a wide range of positions and movements to minimize damage to soft tissue due to friction and shear.

In other embodiments, the apparatuses include multiple identical inflatable parallel sacs that are positioned on the multi-layered pneumatic levers configured to raise and lower legs. In certain embodiments, the sacs are split in a lower half of the apparatus along the longitudinal center line allowing the legs to be raised and lowered independently of one and other to simulate a bicycle action or other independent leg actions.

In other embodiments, the base of the apparatus is also used as a top of a packaging shell that resembles a compact suitcase.

The apparatuses of this invention may be used to position a patient in a positions that would be of medical benefit or may be configured to exposed the patient to a sequence of movements. The movement sequences may be manually entered or may be programmed into the processing unit so that the apparatuses will executed the sequence randomly, intermittently, semi-periodically, periodically, or according to a schedule. Thus, a user may manually adjust the inflation of the inflatable members to raise a patient from a lying position to a sitting position and then through a bicycle type motion of the legs, or the user may program the sequence into the processing unit or transmitted the sequence from a remote computer to the processing unit, and the processing unit would execute the sequence once, randomly, intermittently, semi-periodically, periodically, or according to a defined schedule.

The apparatuses includes an adjustment assembly comprising hook and loop strap that allow one, some or all of the inflatable sacs and levers to be adjusted to conform to a patients body. Thus, prior to pressure being applied to the inflatable members of the apparatus, the adjustment members are adjusted so that the sac and lever members best match (conform to) a patient's body proportions. Once adjusted to a patient, the patient is laid down on the apparatus along its central longitudinal axis. The physical characteristics of each patient are taken into consideration when setting up the apparatus so that pressure is directed to the correct points on the body. Pressure is then applied to various parts of the body such as the spine, left and right side of the torso and the legs in accordance with the patient's set programme of rehabilitation that has been formulated to meet their specific medical requirements.

A method for changing the position of the body and apparatus for its realization involves the redistribution of pressure on the upper spine, legs, right and left sides of the trunk. A new feature in the method is that prior to the patient being laid down on the apparatus surface the apparatus is adapted to the patient's body proportions using its adjustable features. Once the patient is lying on the apparatus air pressure is introduced into it and regulated so as to increase and decrease pressure on different parts of the body during selected timeframes and patient body positioning actions. In addition the apparatus facilitates further treatment of other parts of the body by moving the body into various trajectories such as raising and turning the head, raising and turning the chest, turning and lifting the whole back, raising and lifting the lumbar, raising and lifting the pelvis, raising and bending the legs together at the knee or at the hip and in one embodiment of the invention raising the legs separately at the knee or the hip in a 'bicycle' fashion. Aligning the patient correctly on the apparatus is necessary for the maximal beneficial impact of the given treatment programs. The apparatus allows for the introduction of pressure to different sections of the body which when regulated moves the body into different trajectories and in doing so provides a highly rehabilitative effect.

The method as stated above wherein the application of pressure to the body so as to move it in three dimensions and in various combinations, in particular, in both the lying and sitting positions respectively, turning the legs and spine, lifting the legs to any angle, turning the legs and spine in different directions, lifting and turning the body at the pelvis, lifting and turning the body at the waist and providing a massage effect. Such patient specific movement combinations may be programmed directly into the apparatus controller or via its dedicated computer software interface.

The method as stated above further comprising a support surface of a number of parallel inflatable air sacs that are placed on multi-layered inflatable pneumatic levers made out of a strong hermetic material that are of different diameters and different lengths which are attached to longitudinal multi-layered inflatable side pneumatic levers that are all interconnected by flexible air tube connections to multi-layered inflatable pneumatic envelope levers which are all connected to a controlling apparatus to regulate the inflation and deflation of said sacs and multi-layered pneumatic levers. Some of these multi-layered pneumatic levers are made of tubes of a cigar shape or other forms that are created by folding the tubes back on themselves at a chosen point in the longitudinal direction and then affixing hook and loop tape across and inside the fold and then anchoring the hook and loop to the apparatus base and/or an adjoining air tube. This hook and loop fixing then becomes the fulcrum and hinge for the pneumatic lever which operates through the introduction of air into the pneumatic air lever tube the upper folded over section of which then lifts and arcs upwards as a lever arm from and around the hook and loop hinge point. When air is pumped out of the same pneumatic lever the upper folded over section lowers and arcs back down as a lever arm around the same Velcro hinge point. Such pneumatic levers move the entire patient's upper body and legs into different trajectories. These pneumatic levers are multi layered with certain hermetic material layers giving the tubes added rigidity and balance and certain layers comprising additional air tubes made of hermetic material that may be inflated and deflated so as to give added functionality to the pneumatic levers which in one embodiment of the invention allows air levers to lift the knees of the patient without the requirement to lift the whole leg and in another embodiment of the invention to lift a chosen area of the patient's back without having to lift the whole of the patient's upper body. Such pneumatic levers are combined into sections of pairs that are placed at the optimal position below the patient symmetrically at either side of the longitudinal centre line. Other pneumatic levers take the form of two or more inflatable envelopes of different sizes and of various shapes and made of strong hermetic material. These envelopes are joined and overlap one and other and when they both or are all inflated simultaneously they raise evenly and lift the body area of the patient under which they are located in an upwards direction. When these envelopes are inflated and deflated in designated and controlled sequences they may also move the body area of the patient under which they are located in different sideways and forward trajectories. Such multi-layered pneumatic levers are used to lift and turn the head and neck, the thoracic spine, the pelvis or other chosen body areas. These pneumatic levers are multi layered with certain hermetic material layers giving the tubes added rigidity and balance and certain layers comprising additional air tubes made of hermetic material that may be inflated and deflated so as to give added functionality to the pneumatic levers.

The method as stated above wherein the apparatus has an outer upper covering shell of elasticated material that covers the entire longitudinal and transverse upper area of the apparatus and which is connected to the parallel inflatable support surface sacs below it by means of Velcro fixings. These parallel inflatable sacs are positioned on top of the multi layered pneumatic levers that are fixed and position adjustable on a rigid corrugated plastic base through which the various flexible plastic air hoses run from the main pump-controller to the multiple parallel inflatable air sacs, pneumatic levers and multi-layered longitudinal pneumatic inflatable side levers which are in the form of long tubes made of strong hermetic material that can have their diameter adjusted at required points so as to fit to the patient's requirements such a the hip and knee joints position.

The method as stated above wherein the abovementioned means also facilitates the movement of the patient's body in three dimensions and in various combinations, in particular, in both the lying and sitting positions respectively, turning the legs and spine, lifting the legs to any angle, turning the legs and spine in different directions, lifting and turning the body at the pelvis, lifting and turning the body at the waist and providing a massage effect.

The method as stated above wherein the multiple identical parallel inflatable sacs, the multi layered pneumatic levers, multi-layered longitudinal pneumatic inflatable side levers and the base are connected to one and other symmetrically along the longitudinal axis by means of elastic Velcro fixing tape and furthermore the multiple identical and parallel inflatable sacs are arranged and fixed on parallel Velcro fixing strips. The use of such Velcro fixings on the apparatus allows for its easy assembly and disassembly.

The method as stated above wherein fully pneumatic construction of the apparatus and the use of elastic fittings to connect the multiple identical inflatable parallel inflatable sacs with one and other and with all the pneumatic levers and the base allows the apparatus to contour itself to the patient's body form and combined with the smooth interaction and movement of the pneumatic levers assists in changing the position of the patient with a wide range of movement and minimises damage to the soft tissue of the patient through friction and shear.

The method as stated above wherein the multiple identical inflatable parallel inflatable sacs which are positioned on the multi-layered pneumatic levers for raising and lowering the legs are split in the lower half of the apparatus down the longitudinal centre line allowing the legs to be raised and lowered independently of one and other in a bicycle fashion.

The method as stated above wherein the odd and even flexible air hoses from the multiple identical parallel inflatable sacs are connected with the multi-layered longitudinal pneumatic inflatable side levers.

The method as stated above wherein the corrugated plastic material that forms the base of the apparatus is also used as a packing material of the apparatus so that when packed it resembles a compact suitcase.

Suitable Materials for Use in the Invention

The sacs of this invention may be constructed of any air impermeable, flexible, and resilient polymers. Suitable polymers include, without limitation, homo, copolymer, terpolymers, or high compositional polymers comprising one or more ethylenically unsaturated monomers, diene monomers, urethane monomers, ester monomers, silicon monomers, other air impermeable, flexible, and resilient polymers, or mixtures and combinations. Exemplary examples of homo, copolymer, terpolymers, or high compositional polymers include, without limitation, polyolefins, polyurethanes, polyesters, polysiloxanes, silicones, fluoropolymers, thermoplastic elastomers, other plastic materials or mixtures and combinations thereof. Exemplary examples of polyolefins include, without limitation, polyethylenes, polypropylenes, polybutylenes, polyisobutylenes, EPDMs, polystyrenes, polyvinylchlorides, polyvinylalcohol, fluorinated polyolefins, copolymers of ethylene and propylene, or copolymer and higher monomer composition olefin monomers.

The layered materials of this invention may be constructed of films of the above polymers laminated to form laminates or crossliminates. These laminates and/or cross-laminates may include reinforcement materials such a nylon, polyester fibers, cotton fibers, dacron fibers, carbon fibers, any other fibrous materials and mixtures or combinations thereof.

The tubing materials of this invention may be constructed of the polymers listed above. Exemplary examples include, without limitation, Tygon® tubing or other tubing.

DETAILED DESCRIPTION OF THE DRAWINGS

Figure 1:
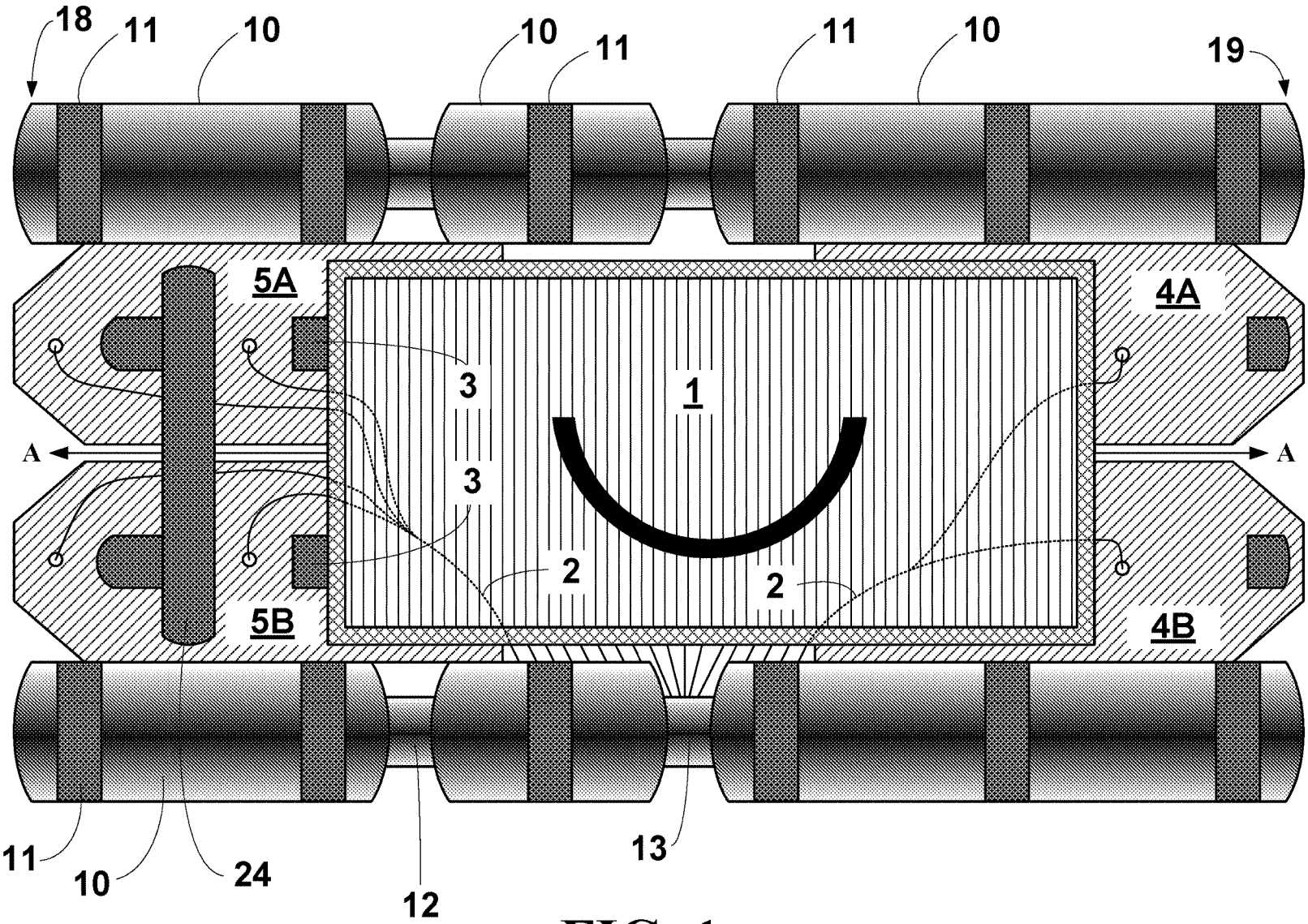
FIG. 1 depicts an underside or bottom view of an embodiment of an inflate bed apparatus 100.

Referring now to FIG. 1, an embodiment of an inflatable bed apparatus of this invention, generally 100, for changing a patient body position is shown to include a firm base 1 made out of non-deformable corrugated plastic sheeting with holes for flexible air hoses or conduits 2, which are used to regulate the pressure in the inflatable members described below. The hoses 2 run inside the corrugated plastic base member 1. The apparatus 100 also includes two hook and loop tape strips 3 extends longitudinally along a length the base member 1. The strips 3 are used to attach the inflatable member of the apparatus 100 to the base 1 as described below and shown in the drawings.

FIGS. 2-10 Show Different Views and Configurations of the Bed 100

Figure 2:
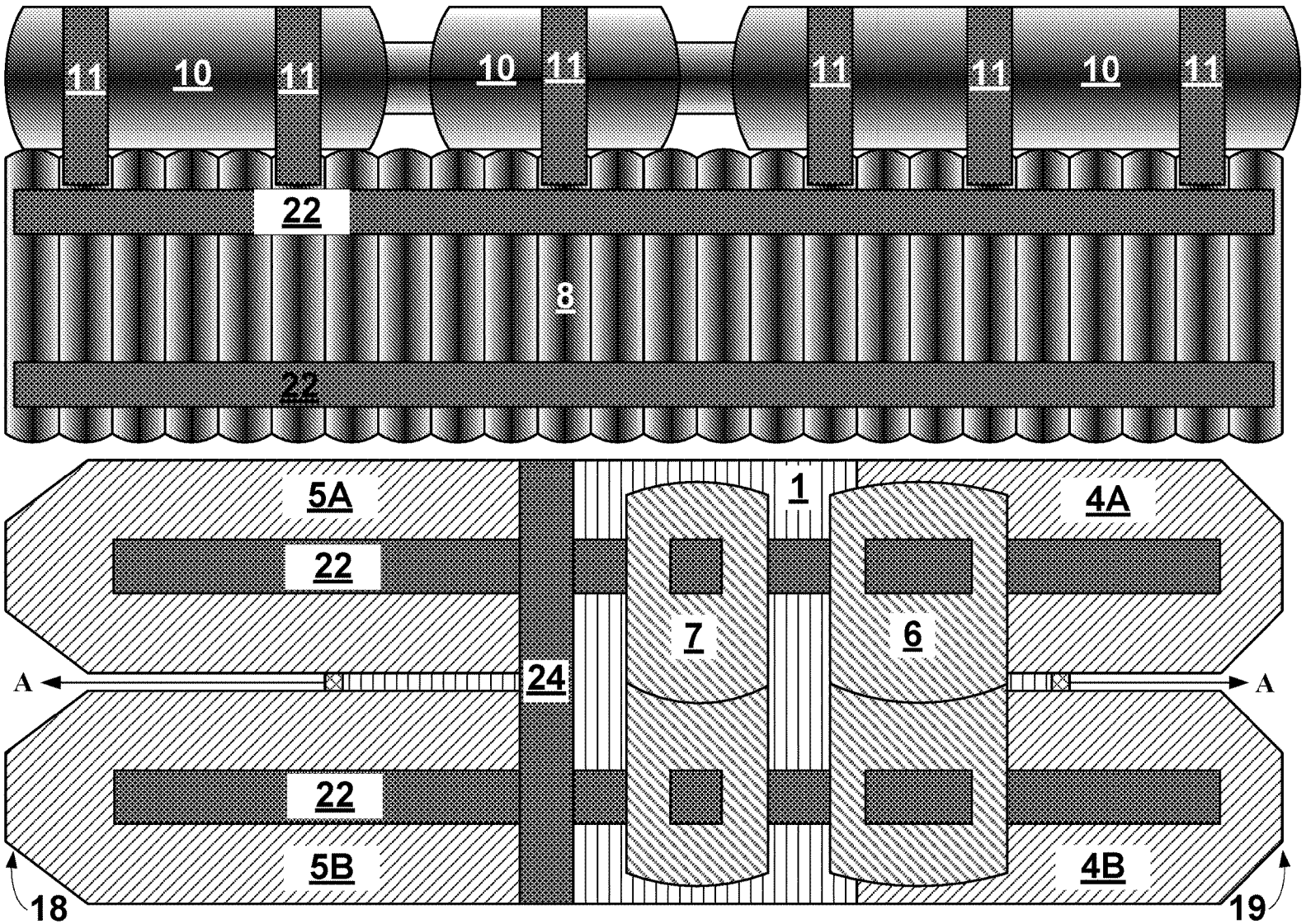
FIG. 2 depicts a semi assembled view of the apparatus 100 opened up from one side.

Referring now to FIG. 2, an embodiment of the bed apparatus 100 is shown to include two elastic band fixing member 3A joining or holding together a plurality of identical inflatable parallel support sacs 8 extending longitudinally on a bottom of the sacs 8 and located on each side of the sacs 8. The apparatus 100 also includes two multi-layered inflatable upper lever members 4A and 4B used to raise, lower, twist, and/or turn areas of a spine and/or a whole upper body of a patient, where the lever members 4A and 4B extend from a head portion of the base 1 to a head end 18 of the apparatus 100. The apparatus 100 also includes two multi layered inflatable lower lever members 5A and 5B used to raise, lower, twist, and/or turn legs and/or a whole lower body of a patient, where the lever members 5A and 5B extend from a foot portion of the base 1 to a foot end 19 of the apparatus 100. The apparatus 100 also includes a multi-layer inflatable upper back envelope member 6 used to lift and lower a thoracic spine area of the patient. The apparatus 100 also includes a multi-layer inflatable pelvis envelope member 7 that is used to lift and lower a pelvis area of the patient. These inflation members are deposed so that the patient may be repositioned about a central longitudinal axis AA of the apparatus 100 by changing air pressure in one, some, or all of the inflatable members.

The lever members 4A, 4B, 5A, and 5B include cuff or adjustment members 23 that may be positioned to alter a fulcrum of each of the lever members 4A, 4B, 5A, and 5B so that different inflation profiles may be achieved to achieve a desired position. It should be recognized that the lever members 4A and 4B or 5A, and 5B may be of a unitary construction, single member having different inflatable sections. The lever members 4A, 4B, 5A, and 5B also include: (a) hook and loop strips 22 extending down a central region of a top of the members 4A, 4B, 5A, and 5B adapted to detachably affixing the members 4A, 4B, 5A, and 5B, (b) laterally extending hook and loop strips 24 situated near a head end of the member 4A and 4B and near a foot end of the members 5A and 5B, and (c) adjustable lateral extending look and loop strips 22 adapted to change the pivot or fulcrum point of the members 4A, 4B, 5A, and 5B. The members 6 and 7 are slidably mounted on the strips 3 or 22 so that the members 6 and 7 may be adjusted for each patient or may be adjusted to achieve a certain type of lift of the patient.

Figure 3:
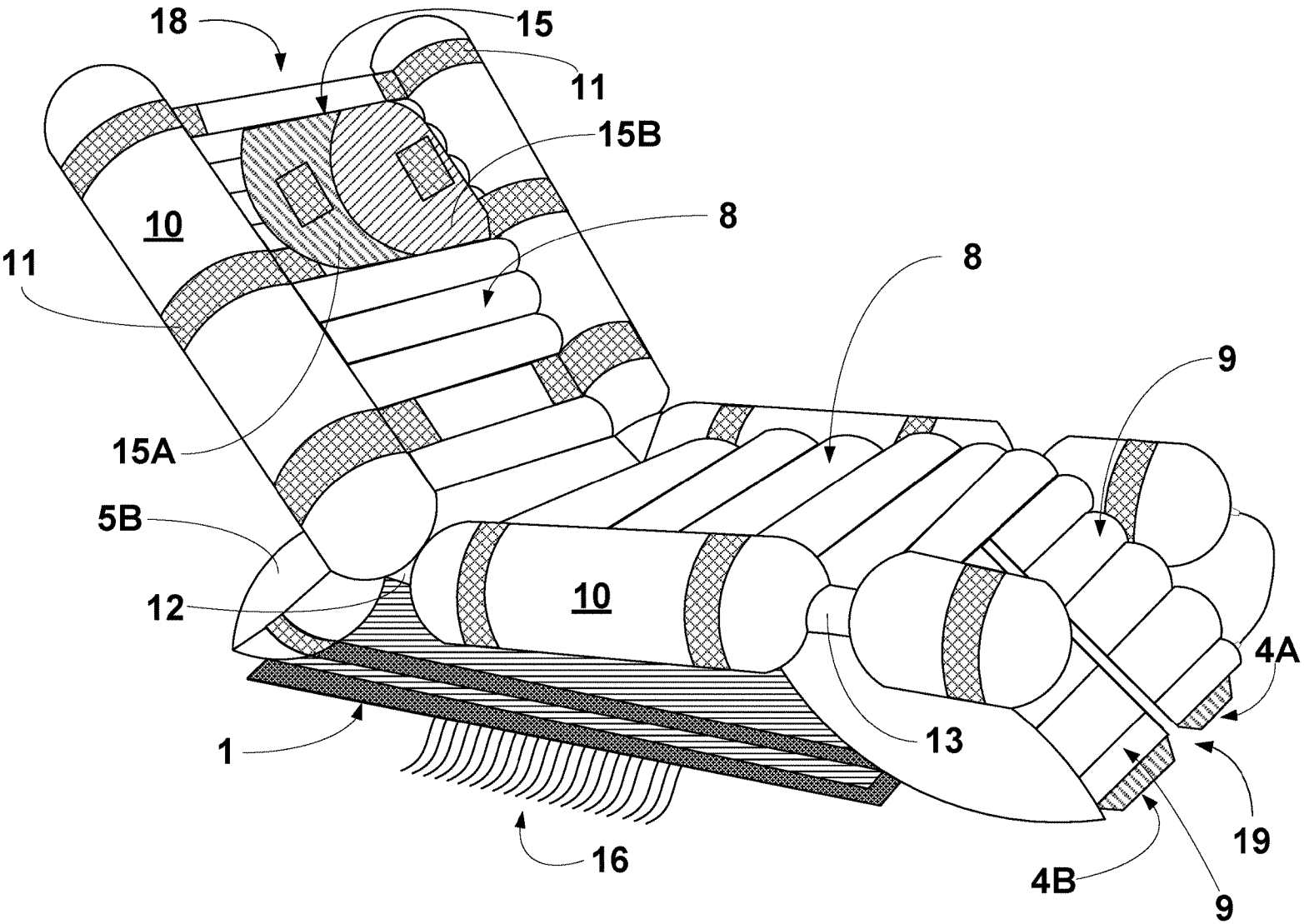
FIG. 3 shows the apparatus 100 inflated into an upper body up and legs down position.

Referring now to FIG. 3, the apparatus 100 is inflatable into a chair type configuration with the lever member 4A and 4B inflated to raise the upper body at the hip and with the member 5A and 5B inflated to raise the knees and lower the feet. The sacs 8 are inflated to support the body in the chair position. The members 4A, 4B, 5A, and 5B are positioned on the base 1 and on the members 10 and the sacs 8 via the hook and loop strips 3, 22, and 24. The apparatus also includes a plurality of flexible air hoses 16 running from the base 1 to the inflation control subsystem/assembly (not shown here) and connected to the hoses 2 that pass through the base 1 and to the inflatable members and sacs. The apparatus 100 also include a pillow or head support member 15 including a first inflatable chamber 15A and a second inflatable chamber 15B. By varying the inflation of the chambers 15A and 15B, the head may be lifted, lowered, and/or turned to the right or to the left.

Figure 4:
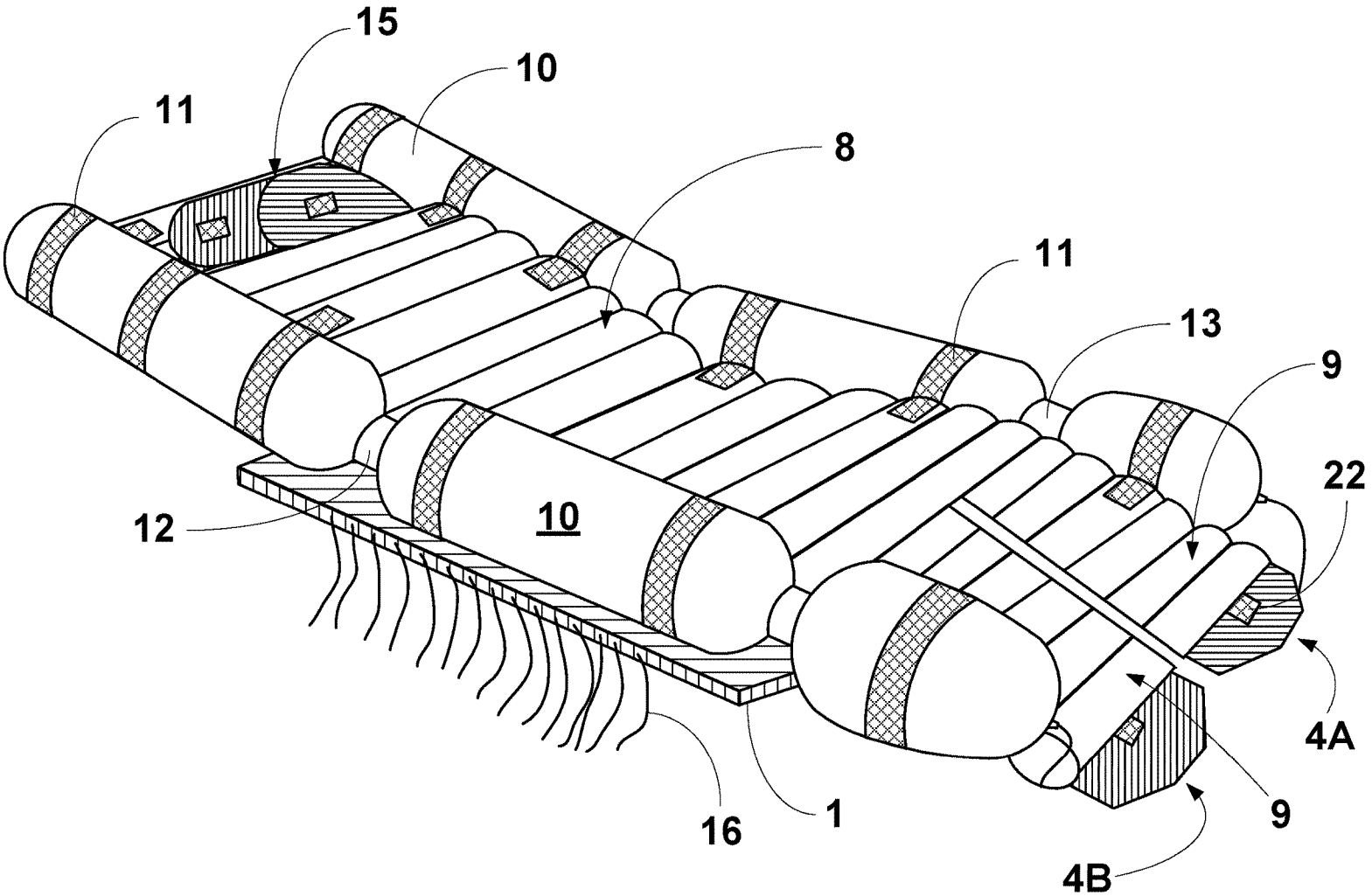
FIG. 4 shows the apparatus 100 inflated in a horizontal lying position.

Referring now to FIG. 4, the apparatus 100 is shown in a horizontal lying position and to include inflatable parallel body sacs 8 and multi-layered longitudinal inflatable side lever members 10 including upper adjustable ring or cuff members 12 and lower adjustable ring or cuff members 13 that function as adjustable hinges or fulcrum locations so that the apparatus 100 may bend at the hip and knees of the patient. The cuff members 12 and 13 may be positioned along a length of the lever members 10 to accommodate each patient so that the when inflated, the lever members 10 and the other inflatable level members and sacs will allow the bed apparatus 100 to pivot at the hip and knees of the patient. The longitudinal inflatable side lever members 10 are connected to the inflatable parallel sacs 8 by hook and loop fixings or ring members 11 at locations along the length of the members 10, where certain of the sacs 8 include look and loop fasteners designed to engage the members 11 to secure the members 10 to the sacs 8.

Figure 5:
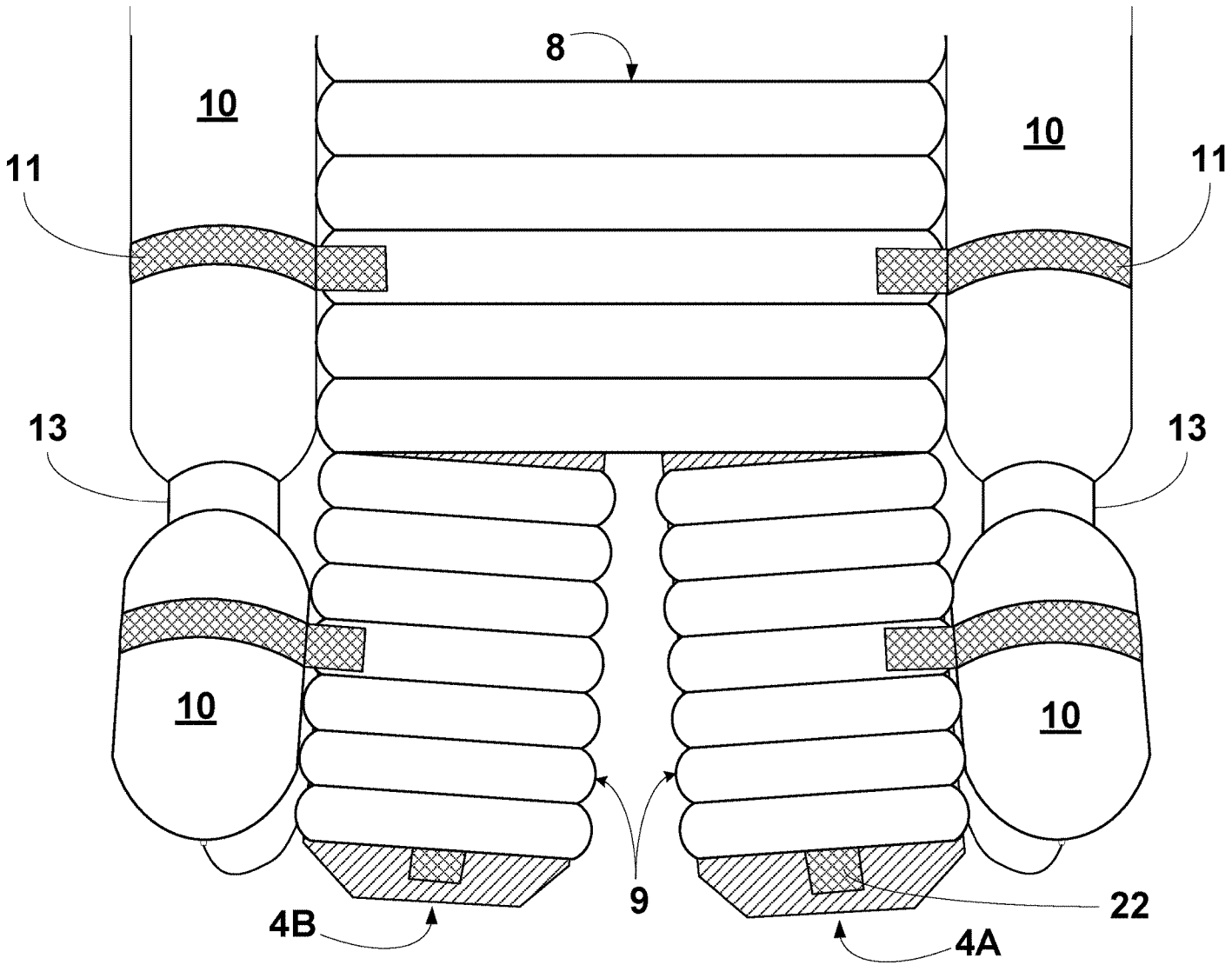
FIG. 5 shows another embodiment of the apparatus 100 including separate leg sacs 9.

Referring now to FIG. 5, the apparatus 100 is shown to include two pluralities of parallel inflatable leg sacs 9 separate from the sacs 8 and disposed at the foot end 19 of the apparatus 100 deposed on each side of the apparatus 100 relative to the longitudinal axis AA. The sacs 9 are used to lower and raise a patient's legs separately. By changing the pressure in the sacs 9 independently according to an inflation/deflation protocol or regiment, the sacs 9 may be used to change the patient's leg positions in a bicycle type action.

Figure 6:
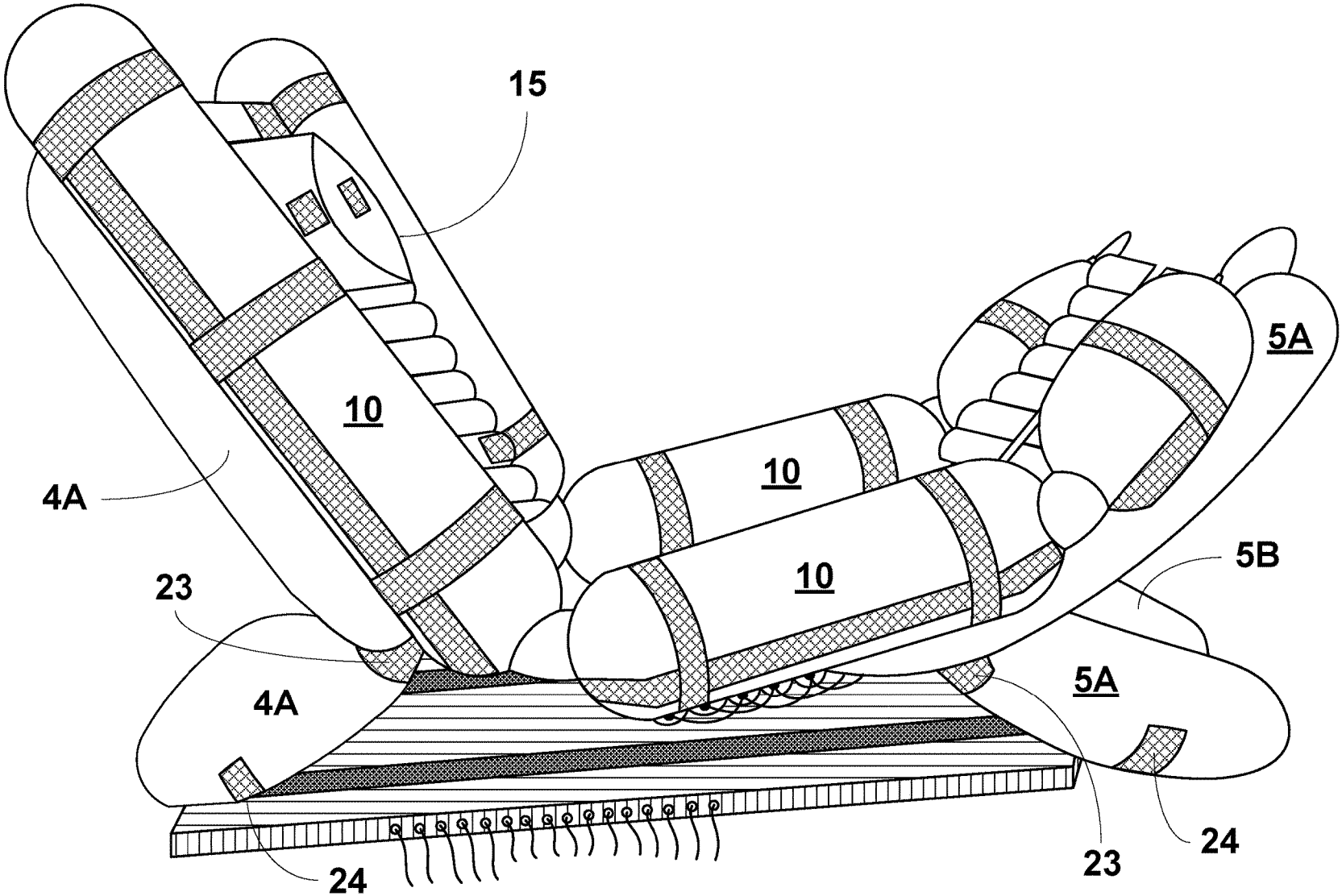
FIG. 6 depicts a right side view of the apparatus 100 inflated into an upper body up and legs up positions.
Figure 7:
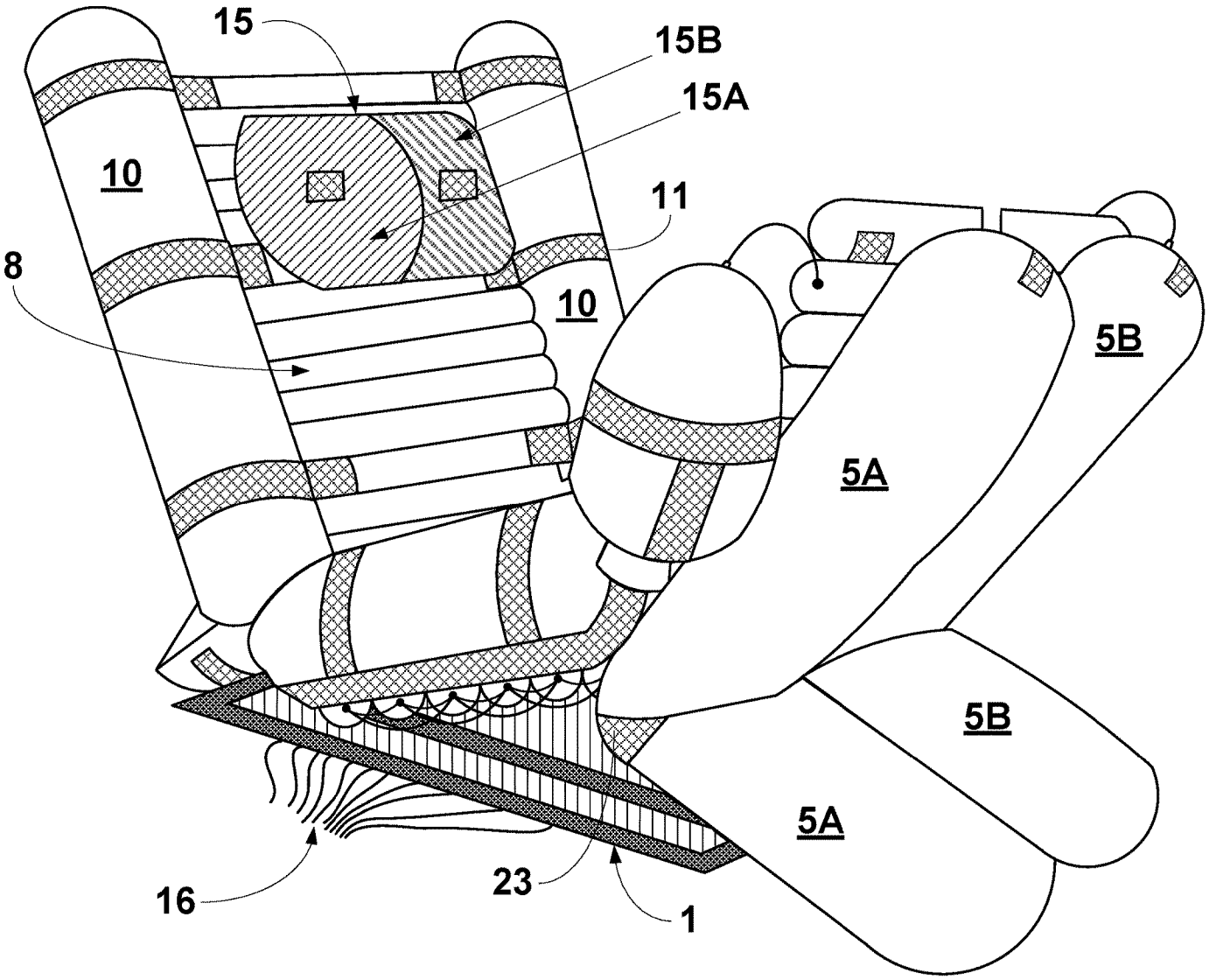
FIG. 7 depicts a right side perspective view of the apparatus 100 of FIG. 6.
Figure 8:
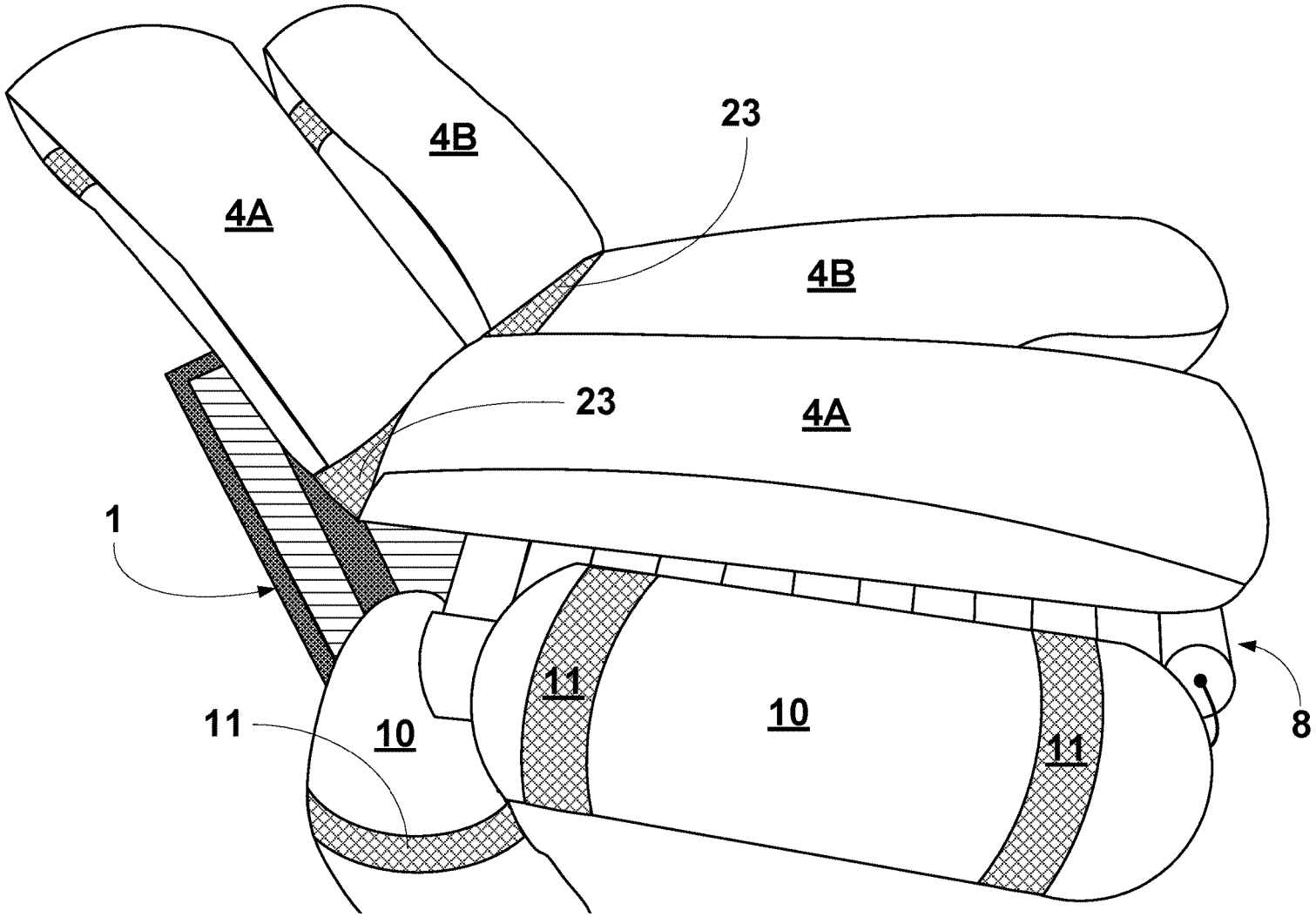
FIG. 8 shows another right side perspective view of the apparatus 100 for FIG. 6.

Referring now to FIGS. 6-8, the apparatus 100 is shown in an upper body raised, lower body raised configuration showing. In this configuration, the inflatable lever members 4A and 4B are inflated to raise the upper body. Of course, by deflating the inflatable lever members 4A and 4B, the upper body may be lowered. By changing a relative pressure in the inflatable lever members 4A and 4B, the upper body may be twisted and/or turned. In this configuration, the inflatable lever members 5A and 5B are inflated to raise the lower body. Of course, by deflating the inflatable lever members 5A and 5B, the lower body may be lowered. By changing a relative pressure in the inflatable lever members 5A and 5B, the lower may be twisted and/or turned. In this configuration, the lever head envelope member 15 including the two separately inflatable sections 15A and 15B are deflated. The sections 15A&B may be inflated collectively or separately to raise, lower, twist and/or turn the head about the neck.

Figure 9:
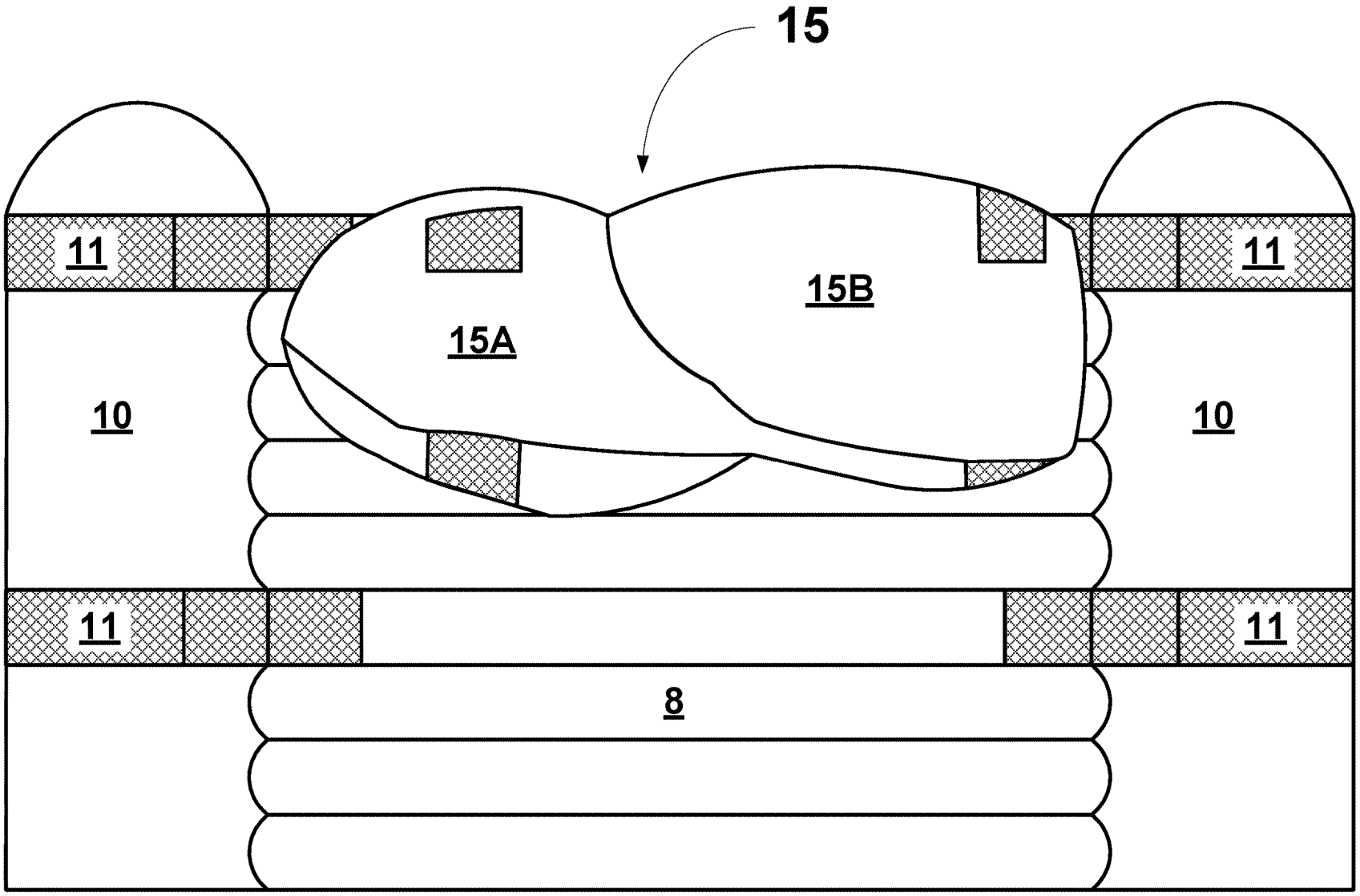
FIG. 9 shows an upper centered view of the apparatus 100 showing the pneumatic lever envelope member 15.

Referring now to FIG. 9, the apparatus 100 is shown with the head member 15 including the chambers 15A and 15B fully inflated so that the head will be lifted. Of course, by changing the relative pressure in the chamber, the head may be twisted and/or turned to the right or left and by deflating, the head may be lowered.

Inflation Control Assembly

Figure 10A:
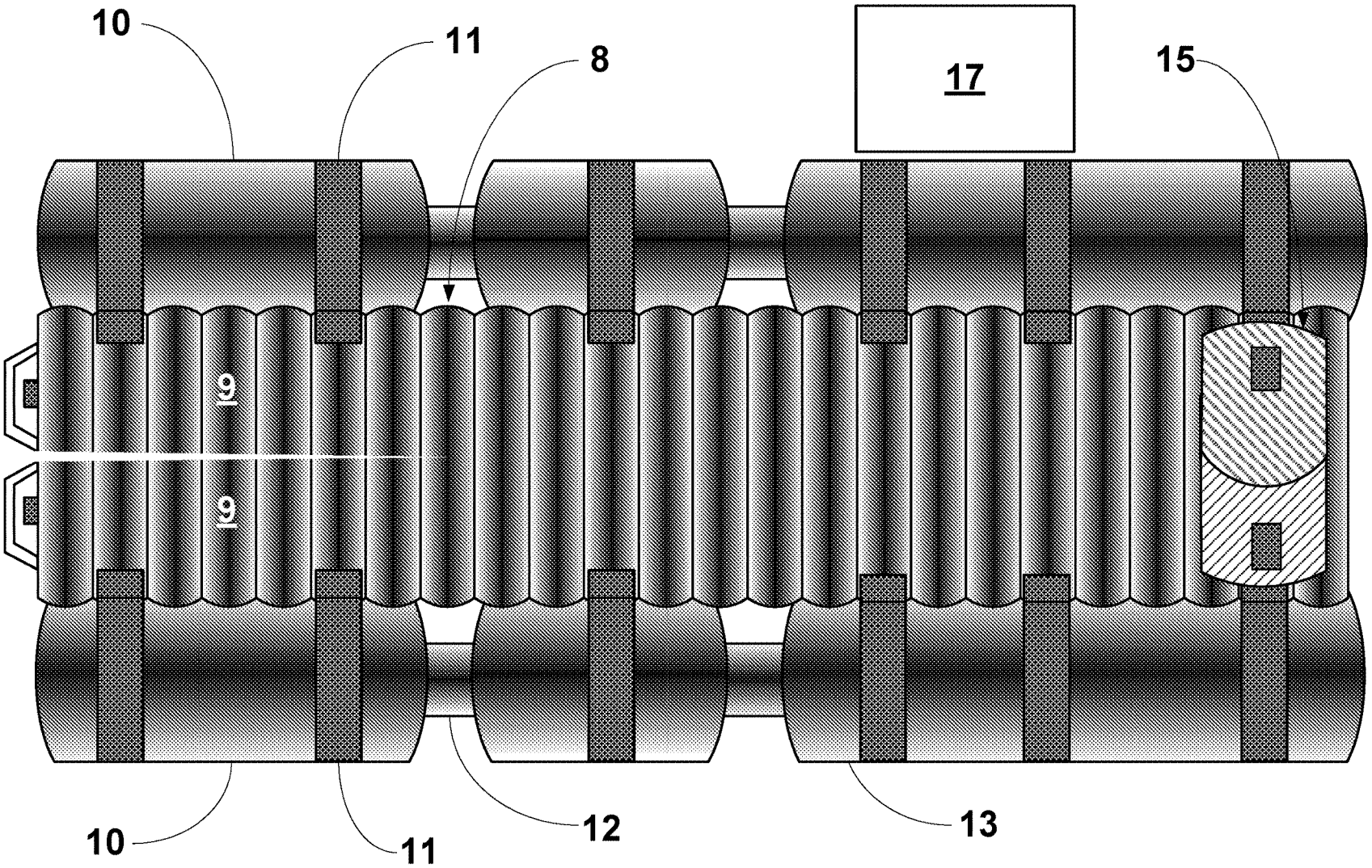
FIG. 10A shows the apparatus 100 with the inflation control subsystem/assembly 17.
Figure 10B:
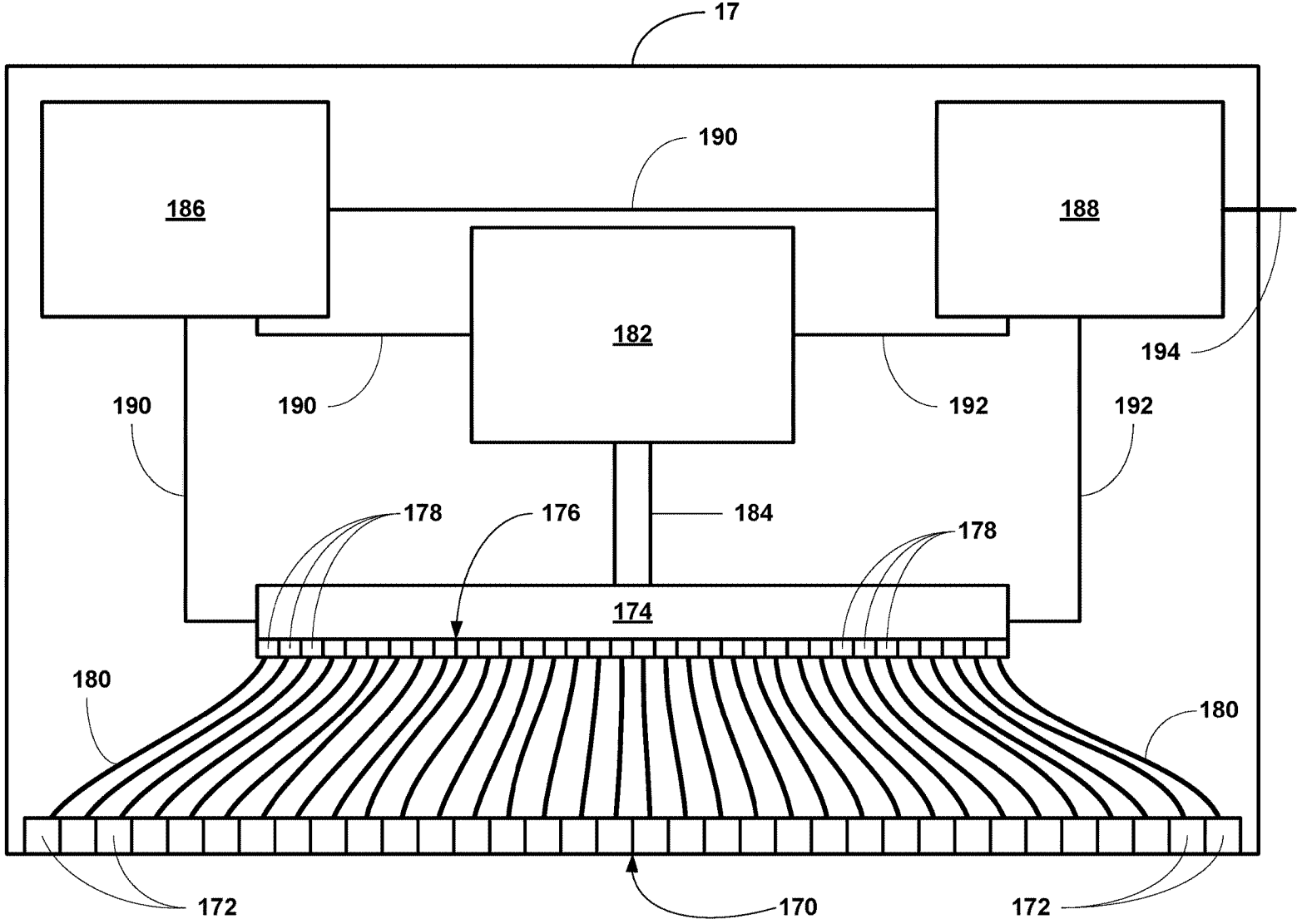
FIG. 10B depicts an embodiment of the inflation control subsystem/assembly 17.
Figure 10C:
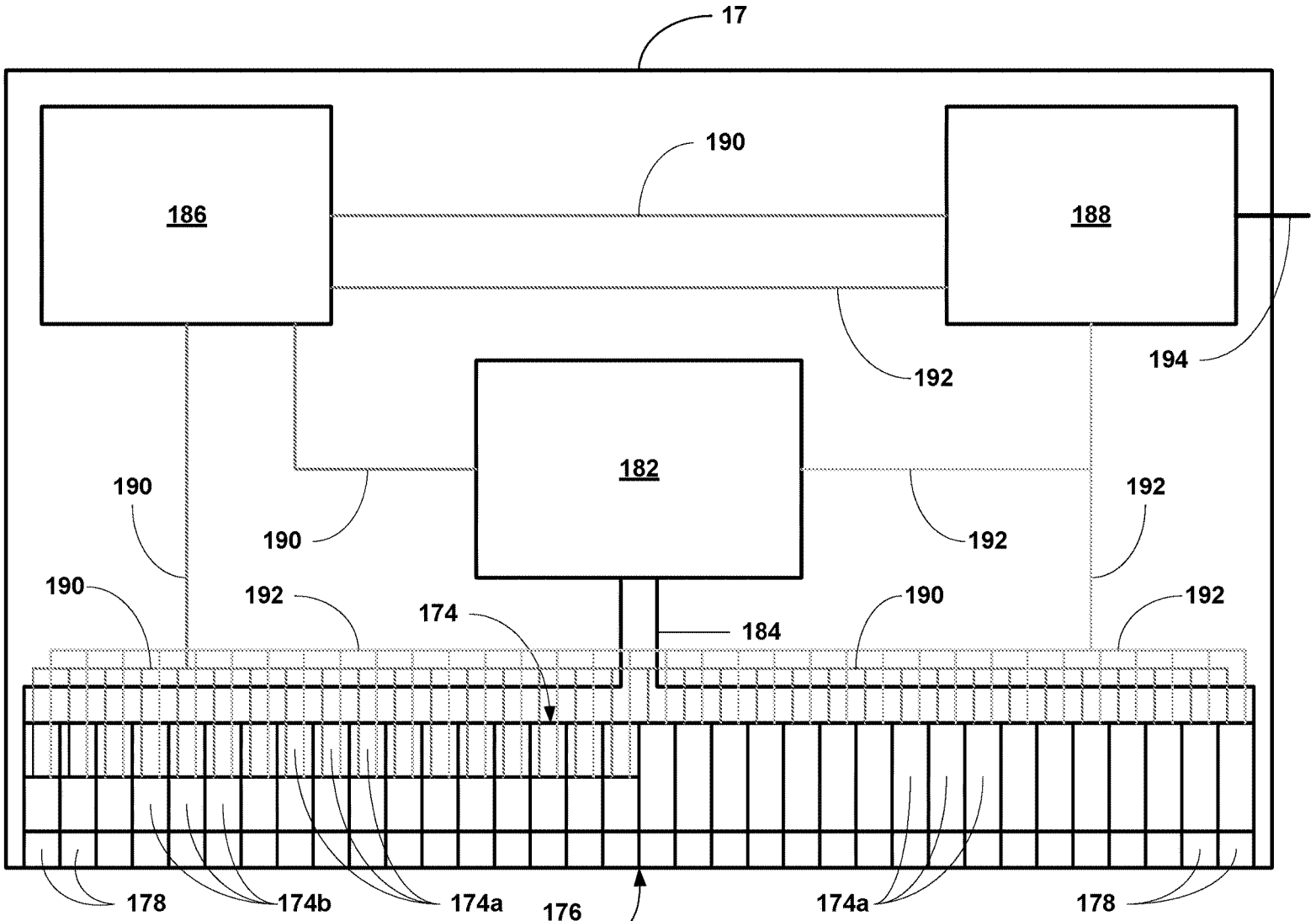
FIG. 10C depicts another embodiment of the inflation control subsystem/assembly 17.

Referring now to FIGS. 10A-D, the apparatus 100 is shown with the inflation control subsystem/assembly 17, which includes at least one pump, fittings to receive the tubes 16, at regulator to regulate air pressure supply to each tube 16, a processing unit including a CPU, memory, one or more mass storage devices, communication hardware and software for wired or wireless communication, and a power supply. The power supply may be a simple as a plug for an electrical outlet or may include a plug for an electrical outlet and a rechargeable battery or batteries for field use. Looking at FIG. 10B, an embodiment of the inflation control assembly 17 is shown to include a tube outlet manifold 170 including fittings 172 for receiving the tube 16. The assembly 17 also include a pressure control or pressure regulator unit 174 including a control output manifold 176 having fitting 178. The assembly 17 also includes internal tubes 180 interconnecting each fitting 172 to a corresponding fitting 178. FIG. 10C shows an alternate embodiment, where the outlet manifold 170, fittings 172, and tubes 180 are removed that the control output manifold 176 is adapted to directly receive the tubes 16.

Looking at FIG. 10B, the assembly 17 further includes a pump 182 including an output conduit 184 connecting the pump 182 to the manifold 174. The manifold 174 receives the output from the pump 182 and regulates air pressure in each tube 180 and thereby in each tube 16 and ultimately in each tube 2 so that the pressure in each inflatable member of the inflation assembly may be regulated. In the alternative embodiment of FIG. 10C, the pump 182 and regulates air pressure supplied to each fitting 178 and thereby in each tube 16 and ultimately in each tube 2 so that the pressure in each inflatable member of the inflation assembly may be regulated. The manifold 174 includes a plurality of electrically controlled valves 174*a* or a plurality of electrically controlled valves 174*a* and electrically controller gas flow controllers 174*b*, as illustrated by FIG. 10C.

The assembly 17 also includes a processing unit 186 and a power supply unit 188. The processing unit 186 is in communication with the pump 182 and each of the electrically controlled valves 174*a* and each of the electrically controlled gas flow controller 174*b* of the manifold 174 via communication pathways 190. The power supply 188 supplies power to the processing unit 186 and each of the electrically controlled valves 174*a* and each of the electrically controlled gas flow controller 174*b* of the manifold 174 via power cables 192. The power supply 188 also includes a cable 194 for connecting the power supply 188 to a wall outlet not shown. The power supply 188 may be a power regulator for regulating 120 V outlet power to the power need for the power consuming components or may include a regulator and batteries, rechargeable or non-rechargeable, for regulating 120 V outlet power to the power need for the power consuming components and supply power when not plugged into a wall outlet.

Figure 10D:
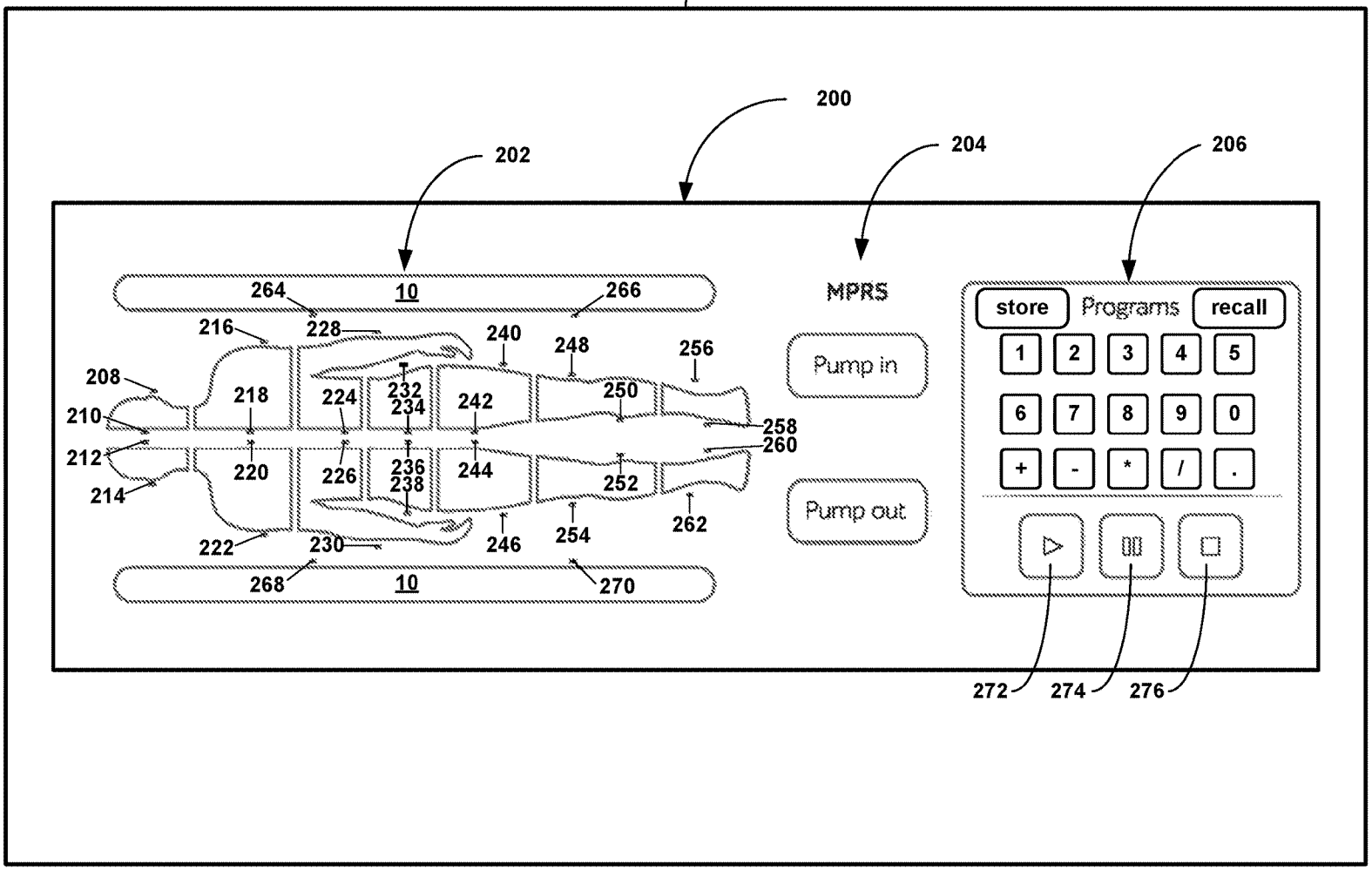
FIG. 10D depicts another embodiment of the inflation control subsystem/assembly 17 having a control panel.

Looking at FIG. 10D, the assembly 17 further includes a control panel 200. The control panel 200 includes a body section 202, a pump control section 204, and a programming section 206. The body section 202 includes four head light emitting diodes (LEDs) 208, 210, 212, and 214, which are used to control the pressure in the sacs 8 and the member 15. These head LEDs 208-214 are used to control the pressure in the member 15. The body section 202 also includes four shoulder LEDs 216, 218, 220, and 222, which are used to control the pressure in the sacs 8 and the members 6 and 7. The body section 202 also includes two upper torso LEDs 224 and 226 and two arm LEDs 228 and 230, which are used to control the pressure in the sacs 8 and the members 6 and 7. The body section 202 also includes four lower torso LEDs 232, 234, 236, and 238, which are used to control the pressure in the sacs 8 and the members 6 and 7. The body section 202 also includes four upper leg LEDs 240, 242, 244, and 246, which are used to control the pressure in the sacs 8 and 9 if present and the members 6 and 7. The body section 202 also includes four lower leg LEDs 248, 250, 252, and 254, which are used to control the pressure in the sacs 8 and 9. The body section 202 also includes four feet LEDs 256, 258, 260, and 262, which are used to control the pressure in the sacs 8 and 9 if present. The body section 202 also includes 264, 266, 268, and 270, which are used to Page 21 control the pressure in the sacs 8 and 9 if present and the members 10.

The pressure control section 204 includes a pump in control button or touch sensitive area and a pump out control button or a touch sensitive area. The pump in button is used to increase a pressure at a given LED location entered into the programming unit 206, while the pump out button is used to decrease a pressure at a given LED location entered into the programming unit 206.

The programming section 206 includes number buttons or touch sensitive areas 0-9 and control buttons or touch sensitive area +, −, *, / and . and store button or touch sensitive area and recall button or touch sensitive area. The programming section 206 also includes a play button or touch sensitive area 272, a pause button or touch sensitive area 274, and a stop button or touch sensitive area 276. These latter buttons 272-276 provide for the play, stop or pause of a programmed sequence for changing the pressure experienced by a patient on the apparatus 100. The key areas 0-9 and the control areas +, −, *, / and . may be used to enter a programmed sequence of pressure changes. Each location 208-270 may be entered into a programming sequence and the pressure at each location 208-270 may be increased or decreased. In the manner, an entire sequence of changing positions or implementing a trajectory for the patient. Once a programming sequence is entered, it may be stored by touching the store area and entering a sequence identifier code. The programmed sequence may then be recall by touching the recall area and entering the sequence identifier code. Once a programmed sequence has been programmed or recalled, the sequence may be played, paused, or stopped using the play area, pause area or stop area.

The LEDs locations 208-270 may also be touch sensitive areas so that by touching the location and then touching the pump in area or pump out area will cause the control assembly 17 to increase or decrease air pressure at that the touched location. Alternatively, the location may be entered using the key areas and then touching the pump in area or pump out area will cause the control assembly 17 to increase or decrease air pressure at that the touched location.

It should be recognized that the touch sensitive panel or button panel 200 will be in communication with the processing unit 186 via a communication path (not shown) and connected to the power supply 188 by a power conduit (not shown).

Apparatuses Including Covers

Figure 11:
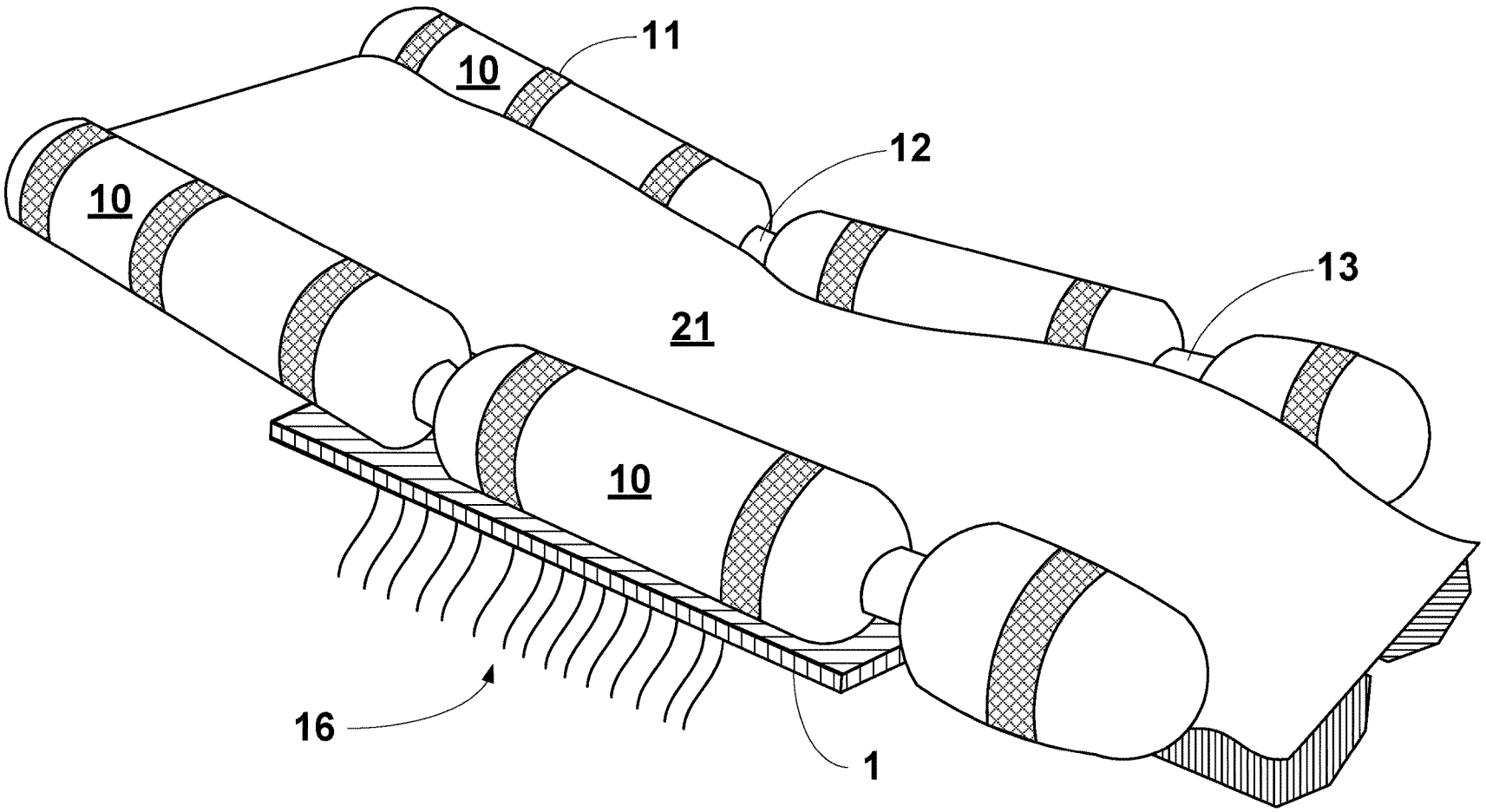
FIG. 11 shows the apparatus 100 including an outer shell 21.

Referring now to FIG. 11, the apparatus 100 is shown in certain embodiments to include a cover 21 adapted to cover the sacs 8 or the sacs 8 and 9. The cover 21 includes a hook and loop tape (not shown) around its outer edge for attaching the cover 21 to the members 10, 8 and/or 9.

Looking further at FIGS. 6-10, an upper surface of the non-deformable corrugated plastic base 1 is shown to include the hook and loop strips 3 with which the base 1 is connected to the multi-layered inflatable lever members 4A, 4B, 5A, 5B, and 10 and the sacs 8 and 9 (if present). The members 4A, 4B, 5A, 5B, and 10 are affixed symmetrically on either side of the longitudinal centerline AA and affixed to a support surface of multiple identical inflatable parallel sacs 8 and the sacs 9 (if present) by hook and loop fixing members, which are in turn connected by hook and loop fixing members 11 of the lever members 10. The multi-layered inflatable envelope member 15 is attached to a top of the sacs 8 at the head end 18 of the apparatus 100, while the members 6 and 7 are attached to a top of the base 1 under the sacs 8 via hook and loop fixing members. In other embodiments, the members 6 and 7 may be attached to the top of the sacs 8 also via hook and loop fixing members. Before all the above mentioned pneumatic lever members are fixed in place, their positions are adjusted taking into account the specific body measurements of the patient to be treated.

In order for the patient be moved comfortably from a lying to a sitting position or from side to side, the apparatus 100 is equipped with the longitudinal multi-layered inflatable side support levers 10 that are connected to the sacs 8 and 9 (if present) via hook and loop fixing members. These longitudinal inflatable multi-layered side support levers 10 include the cuffs 12 and 13 formed with hook and loop tape strips and adjustable along the length of the member 10. The cuffs 12 and 13 function as hinges or fulcrums so that the apparatus 100 may bend at the exact required hip and knee joint positions of a given patient.

In addition, the apparatus 100 may include an outer upper shell 21 which is made of elastic material. In the embodiment of FIG. 11, the shell or cover 21 may cover the sacs 8 and 9 (if present) as described above. In other embodiments, the cover 21 may cover the entire apparatus 100 attached to the base 1 via hook and loop fixing members. The hook and loop fixing points 11 on the longitudinal multi-layered inflatable side support levers 10 or to the hook and loop fixing tape on the multiple identical inflatable parallel inflatable sacs 8 and 9. The pressure control apparatus 17 manages the air inputs that move the patient as is required.

Use of Apparatus to Change Body Positions

The method for changing a patient body position using the inflatable bed apparatus 100 operates as follows. Prior to placing the patient on the apparatus 100, the multiple identical parallel inflatable sacs 8 are inflated to a desired pressure using the pressure control assembly 17. Next, the patient is placed on the upper surface of the apparatus 100 or on top of the cover 21 so that the patient is equally distributed on either side of the longitudinal axis AA. Then, in accordance with a rehabilitation program formulated for the specific patient's requirements, the apparatus 100 moves the patient into various positions or along various trajectories by varying the pressure in the sacs 8 and 9 (if present) and/or in the members 4A, 4B, 5A, 5B, and 10 so that a desired pressure distribution is achieved on the body or on regions of the body such as the spine, the left and right portions of the torso and the legs. In particular, in order to manipulate, the spine into given positions or along given trajectories and with varying amplitudes, it is necessary to inflate and/or deflate multi-layered inflatable pneumatic levers 4A, 4B, 5A, 5B, 6, 7, and/or 15 in a predetermined and sequenced order using the pressure control assembly 17. Furthermore, in order to turn the whole body from side to side in along a given or desired trajectory and with varying amplitudes, it is necessary to inflate and/or deflate the multi-layered inflatable pneumatic levers 4A, 6, 7, 15A, 5A or 4B, 6, 7, 15B, 5B in a predetermined and sequenced order using the pressure control apparatus 17. In order to move the torso from side to side, it is necessary to inflate and/or deflate multi-layered inflatable pneumatic levers 4A, 4B, 6, 7, 15 in a predetermined and sequenced order using the pressure control apparatus 17. In order to move the legs into various positions or along various trajectories, it is necessary to inflate and/or deflate multi-layered inflatable pneumatic levers 5A, 5B, and 7, in a predetermined and sequenced order using the pressure control assembly 17. After the procedures have been carried out, the air may be pumped back out of the air sacs and pneumatic levers.

Compact Carrying Case

Figure 12:
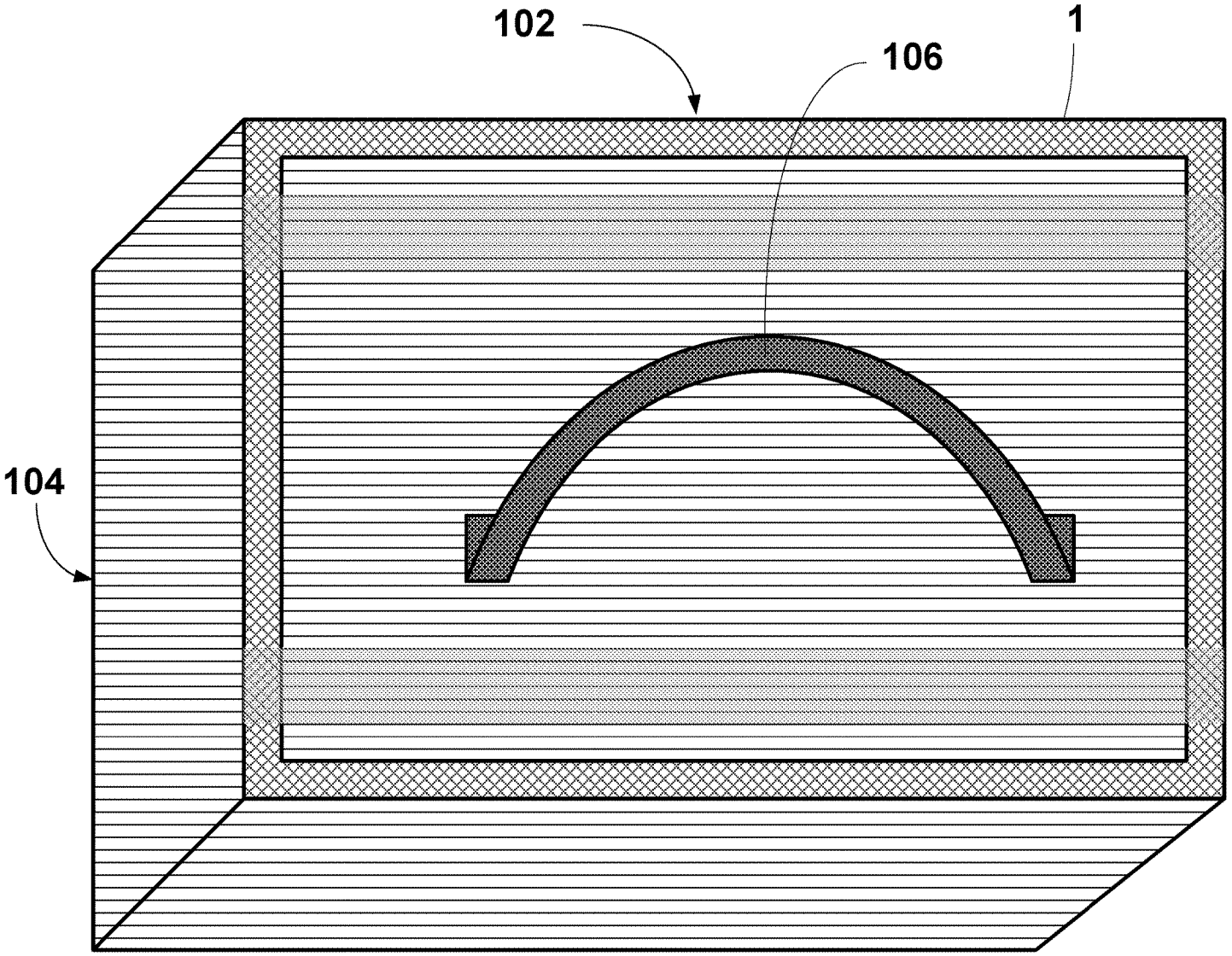
FIG. 12 shows the apparatus 100 in its packed form, where the base 1 forms a top of a compact suitcase structure 102 including an outer cover 104 in which the remainder of the apparatus 100 is secured for ease transportation, deployment and breakdown and a handle 106.

Referring now to FIG. 12, the apparatus 100 is shown contained within a carry case 102. The base 1 forms the top of the case 102 and includes a handle 106. The case 102 also include a cover 104, which may be affixed to the base 1 via look and loop members or a zipper or other attachment member.

Use of Bed to Position Patients in a Variety of Positions

Referring now to FIGS. 13-24, the apparatus 100 is shown with a patient lying thereon in different inflation modes.

Looking at FIG. 13, the patient is shown in a head up horizontal lying position on the inflated apparatus, where the sacs 8 or the sacs 8 and 9 and one chamber of the lever member 15 are inflated to a desired pressure to achieve the head up horizontal lying position.

Looking at FIG. 14, the patient is shown in a head turned right horizontal lying position, where the sacs 8 or the sacs 8 and 9 and both chambers of the lever member 15 are inflated to a desired pressure to achieve the head turned right horizontal lying position. In the position, the left chamber of member 15 is inflated to a higher pressure than the right chamber of member 15.

Looking at FIG. 15, the patient is shown in a chest up horizontal lying position, where the sacs 8 or the sacs 8 and 9 and the lever member 6 are inflated to a desired pressure to achieve the chest up horizontal lying position. In other positions, the member 15 may be inflated so that the head and the chest are raised collectively or independently. In other positions, the member 15 may be inflated so that the head is turned right or left.

Looking at FIG. 16, the patient is shown in a back up horizontal lying position, where the sacs 8 or the sacs 8 and 9 and the lever member 7 are inflated to a desired pressure to achieve the back up horizontal lying position. In other positions, the member 15 may be inflated so that the head and the back are raised collectively or independently. In other positions, the member 15 may be inflated so that the head is raised and/or turned right or left.

Looking at FIG. 17, the patient is shown in a raised thoracic spine horizontal lying position, where the sacs 8 or the sacs 8 and 9 and the lever members 5A and 5B are inflated to a desired pressure to achieve the raised thoracic spine horizontal lying position. In this position, the members 5A and 5B are adjusted and inflated so that the knees are raised, which the feet are lower then the knees. In other positions, the member 15 may be inflated so that the head is raised and/or turned right or left.

Looking at FIG. 18, the patient is shown in a partially raised left leg horizontal lying position, where the sacs 8 or the sacs 8 and 9 and the lever members 5A and 5B are inflated to a desired pressure to achieve the partially raised left leg horizontal lying position. In this positions, the member 5B has a higher pressure than the pressure in the member 5A so that the patient is titled about the hips to the right. In other positions, the member 15 may be inflated so that the head is raised and/or turned right or left.

Looking at FIG. 19, the patient is shown in a raised leg sitting position, where the sacs 8 or the sacs 8 and 9, the level members 4A and 4B, and the lever members 5A and 5B are inflated to a desired pressure to achieve the partially raised left leg horizontal lying position. In other positions, the member 15 may be inflated so that the head is raised and/or turned right or left.

Looking at FIG. 20, the patient is shown in a raised leg horizontal lying position, where the sacs 8 or the sacs 8 and 9 and the lever members 5A and 5B are inflated to a desired pressure to achieve the raised leg horizontal lying position. In other positions, the member 15 may be inflated so that the head is raised and/or turned right or left.

Looking at FIG. 21, the patient is shown in a right titled, raised leg horizontal lying position, where the sacs 8 or the sacs 8 and 9 and the lever members 5A and 5B are inflated to a desired pressure to achieve the right titled, raised leg horizontal lying position. In the position, the pressure in the member 5A is greater than the pressure in the member 5B. In other positions, the pressure in the member 5B is greater than the pressure in the member 5A resulting in a left titling of the legs. In other positions, the member 15 may be inflated so that the head is raised and/or turned right or left.

Looking at FIG. 22, the patient is shown in a raised knees sitting position, where the sacs 8 or the sacs 8 and 9, the level members 4A and 4B, and the lever members 5A and 5B are inflated to a desired pressure to achieve the raised knees sitting position. In other positions, the member 15 may be inflated so that the head is raised and/or turned right or left.

Looking at FIG. 23, the patient is shown in a upper body right tilt, raised legs horizontal lying position, where the sacs 8 or the sacs 8 and 9, the level members 4A and 4B, and the lever members 5A and 5B are inflated to a desired pressure to achieve the upper body right tilt, raised legs horizontal lying position.

Looking at FIG. 24, the patient is shown in a body right tilt, horizontal lying position, where the sacs 8 or the sacs 8 and 9, the level members 4A and 4B, and the lever members 5A and 5B are inflated to a desired pressure to achieve the body right tilt, horizontal lying position.

Of course, it should be recognized that the bed apparatus of this invention is designed so that each inflatable member or chamber may be independently or collectively inflated to a desire pressure to achieve any desired lying or sitting position. It should also be noted that owing to the flexible construction of the apparatus and the way that it contours itself to the patient's body form all the movements carried out are effected without damaging the soft tissue of the patient through friction and shear.

Remote Control Embodiments

Referring now to FIG. 25, the apparatus 100 may also include a remote control unit 201 includes a body section 202, a pump control section 204, and a programming entry section 206. The body section 202 includes four head light emitting diodes (LEDs) 208, 210, 212, and 214. These head LEDs 208-214 are used to control the pressure in the member 15. The body section 202 also includes four shoulder LEDs 216, 218, 220, and 222, which are used to control the pressure in the sacs 8 and the members 6 and 7. The body section 202 also includes two upper torso LEDs 224 and 226 and two arm LEDs 228 and 230, which are used to control the pressure in the sacs 8 and the members 6 and 7. The body section 202 also includes four lower torso LEDs 232, 234, 236, and 238, which are used to control the pressure in the sacs 8 and the members 6 and 7. The body section 202 also includes four upper leg LEDs 240, 242, 244, and 246, which are used to control the pressure in the sacs 8 and 9 if present and the members 6 and 7. The body section 202 also includes four lower leg LEDs 248, 250, 252, and 254, which are used to control the pressure in the sacs 8 and 9. The body section 202 also includes four feet LEDs 256, 258, 260, and 262, which are used to control the pressure in the sacs 8 and 9 if present. The body section 202 also includes 264, 266, 268, and 270, which are used to control the pressure in the sacs 8 and 9 if present and the members 10.

The pressure control section 204 includes a pump in control button or touch sensitive area and a pump out control button or a touch sensitive area. The pump in button is used to increase a pressure at a given LED location entered into the programming unit 206, while the pump out button is used to decrease a pressure at a given LED location entered into the programming unit 206.

The programming section 206 includes number buttons or touch sensitive areas 0-9 and control buttons or touch sensitive area +, −, *, / and . and store button or touch sensitive area and recall button or touch sensitive area. The programming section 206 also includes a play button or touch sensitive area 272, a pause button or touch sensitive area 274, and a stop button or touch sensitive area 276. These latter buttons 272-276 provide for the play, stop or pause of a programmed sequence for changing the pressure experienced by a patient on the apparatus 100. The key areas 0-9 and the control areas +, −, *, / and . may be used to enter a programmed sequence of pressure changes. Each location 208-270 may be entered into a programming sequence and the pressure at each location 208-270 may be increased or decreased. In the manner, an entire sequence of changing positions or implementing a trajectory for the patient. Once a programming sequence is entered, it may be stored by touching the store area and entering a sequence identifier code. The programmed sequence may then be recall by touching the recall area and entering the sequence identifier code. Once a programmed sequence has been programmed or recalled, the sequence may be played, paused, or stopped using the play area, pause area or stop area.

The LEDs locations 208-270 may also be touch sensitive areas so that by touching the location and then touching the pump in area or pump out area will cause the control assembly 17 to increase or decrease air pressure at that the touched location. Alternatively, the location may be entered using the key areas and then touching the pump in area or pump out area will cause the control assembly 17 to increase or decrease air pressure at that the touched location.

The remote control unit 201 of course includes a processing unit, wired or wireless communication hardware and software, and a power supply. The power supply may be a power regulator for regulating 120 V outlet power to the power need for the power consuming components or may include a regulator and batteries, rechargeable or non-rechargeable, for regulating 120 V outlet power to the power need for the power consuming components and to supply power when not being charged.

Experiments of this Invention

Field tests of the apparatus have shown that owing to the large spectrum of trajectories and amplitudes with which the multi-layered pneumatic levers are able to move immobile patients, the apparatuses have provided them with a high level of rehabilitation and prevention of decubitus complications such as pressure ulcers, pneumonia/atelectasis, disuse osteoporosis, impaired digestion and excretion, muscle atrophy, contractures, poorly functioning metabolism, hormonal system and impaired blood and/or lymph circulation. The apparatuses have also been shown to stimulate the early stirring of consciousness in patients.

The bed apparatuses of this invention are well suited for use in medical institutions, in nursing centers or facilities, in rehabilitation centers or facilities, in homes, and in the field. The bed apparatuses of this invention do not require specialized training for its operation and may be used to complement a variety of other medical rehabilitation programs. The apparatuses simplify patient rehabilitation and is simple to maintain.

Closing

All references cited herein are incorporated by reference. Although the invention has been disclosed with reference to its preferred embodiments, from reading this description those of skill in the art may appreciate changes and modification that may be made which do not depart from the scope and spirit of the invention as described above and claimed hereafter.

We claim:

1. A method comprising:

configuring a bed apparatus to a patient, wherein the bed apparatus comprises:

(a) a base assembly;

(b) an inflatable bed comprising:

a right side retaining pneumatic member including at least two adjustment members;

a left side retaining pneumatic member including at least two adjustment members;

at least one chest member detachably attached to the base;

at least one lumbar back member detachably attached to the base;

a right side upper body pneumatic lever member including an adjustment member adapted to adjust a pivot point or fulcrum thereof, wherein the right side upper body pneumatic lever member is detachably attached to the base at one end thereof;

a left side upper body pneumatic lever member including an adjustment member adapted to adjust a pivot point or fulcrum thereof, wherein the left side upper body pneumatic lever member is detachably attached to the base at one end thereof;

a right leg pneumatic lever member including an adjustment member adapted to adjust a pivot point or fulcrum thereof, wherein the right leg pneumatic lever member is detachably attached to the base at one end thereof;

a left leg pneumatic lever member including an adjustment member adapted to adjust a pivot point or fulcrum thereof, wherein the left leg pneumatic lever member is detachably attached to the base at one end thereof;

a pneumatic sac member including a plurality of parallel air sacs detachably attached to the right side retaining pneumatic member and to the left side retaining pneumatic member and comprising a bottom surface and a top surface, wherein the patient is positioned on the top surface, wherein the upper body lever members, the leg lever members, the at least one chest member, and the at least one lumbar back member directly engage a bottom surface of the air sac member at their corresponding positions; and a pneumatic head member including a right side chamber and a left side chamber, wherein the pneumatic head member is disposed on a top surface at a head portion of the sac member and is detactably attached to the right and left retaining pneumatic members;

(c) an inflation control assembly including at least one processing unit, a plurality of air hoses or conduits, a plurality of electrically controlled valves, a plurality of electrically controlled gas flow controllers, a plurality of fittings, and one or more electrically controlled pumps, wherein the valves, controllers, and pumps are in communication with and under control of the processing unit, wherein each of the hoses is connected to one of the fittings at a first end and one of the inflatable members at a second end, and wherein the processing unit controls an air pressure in the sac member and in each of the inflatable members, wherein one, some, or all of the inflatable members comprise multilayered constructs comprising a plurality of inflatable sections or members that give added functionality and rigidity to the inflatable members;

the configuring comprises:

(a) adjusting the adjustment members of the side retaining members to conform to the patient, (b) adjusting a position of the adjustment member of each of the inflatable lever members so that the pivot point or fulcrum to conform to the patient, and (c) positioning the chest and lumbar members to conform to the patient; and inflating (a) the pneumatic sac member, (b) one, some, or all of the inflatable members, or (c) any combination thereof via the inflation control assembly resulting in a bed pressure distribution corresponding to a patient bed configuration.

2. The method of claim 1, wherein, in the inflating step, the patient bed configuration is selected from the group consisting of a raised head position, a turned head position, a raised chest position, a turned chest position, a raised upper back position, a turned upper back position, a raised lower back or lumbar position, a turned lower back or lumbar position, a raised whole back position, a turned whole back position, a raised pelvis position, a turned pelvis position, a raised legs position, a turned legs position, a bent legs position, a turn bent legs position, and any combination of these positions.

3. The method of claim 1, further comprising:

changing the pressure in: (a) the air sac member, (b) one, some, or all of the inflatable members, or (c) any combination thereof one time, intermittently, randomly, semi-periodically, periodically, or according to a programmed sequence, schedule, regime, regiment, or protocol so that the patient bed configuration changes accordingly, wherein the patient bed configurations are selected from the group consisting of a raised head position, a turned head position, a raised chest position, a turned chest position, a raised upper back position, a turned upper back position, a raised lower back or lumbar position, a turned lower back or lumbar position, a raised whole back position, a turned whole back position, a raised pelvis position, a turned pelvis position, a raised leg position, a turned leg position, a raised legs position, a turned legs position, a bent leg position, a turned bent leg position, a bent legs position, a turn bent legs position, and any combination of these positions.

4. The method of claim 1, wherein, in the configuring step:

the right head member chamber includes a pneumatic lever, the left head member chamber includes a pneumatic lever, the chest member includes two chambers, each of the chambers includes a pneumatic lever, and the lumbar member includes two chambers, each of the chambers includes a pneumatic lever.

5. The method of claim 4, wherein, in the configuring step, the sac member further includes:

a right leg sac portion including a plurality of right leg air sacs, and a left leg sac portion including a plurality of left leg air sacs, wherein the right pneumatic leg lever member directly contacts a bottom surface of the right leg sac portion and wherein the left pneumatic leg lever member directly contacts a bottom surface of the left leg sac portion.

6. The method of claim 5, further comprising:

changing the pressure in the air sac member, in one, some, or all of the inflatable members, or any combination thereof one time, intermittently, randomly, semi-periodically, periodically, or according to a programmed sequence, schedule, regime, regiment, or protocol so that the patient bed configuration changes accordingly, wherein the patient bed configurations are selected from the group consisting of a raised head position, a turned head position, a raised chest position, a turned chest position, a raised upper back position, a turned upper back position, a raised lower back or lumbar position, a turned lower back or lumbar position, a raised whole back position, a turned whole back position, a raised pelvis position, a turned pelvis positions, a raised leg position, a turned leg position, a raised legs position, a turned legs position, a bent leg position, a turned bent leg position, a bent legs position, a turn bent legs position, and mixtures or combinations of these positions.

7. The method of claim 1, further comprising:

changing the pressure in (a) the air sac member, (b) one, some, or all of the inflatable members, or (c) any combination thereof according to a programmed sequence.

8. The method of claim 7, wherein, in the changing step, the programmed sequence comprises moving patient body parts along a trajectory.

9. The method of claim 8, wherein the trajectory is selected from the group consisting of raising and turning the head, raising and turning the chest, turning and lifting the whole back, raising and turning the upper back, raising and lifting the lumbar or lower back, raising and lifting the pelvis, raising and bending the legs together at the knee or at the hip, raising and bending each leg separately at the knee or at the hip, and mixtures or combinations thereof.

10. An apparatus comprising:

(a) a base assembly;

(b) an inflatable bed comprising:

a right side retaining pneumatic member including at least two adjustment members;

a left side retaining pneumatic member including at least two adjustment members;

at least one chest member detachably attached to the base;

at least one lumbar back member detachably attached to the base;

a right side upper body pneumatic lever member including an adjustment member adapted to adjust a pivot point or fulcrum thereof, wherein the right side upper body pneumatic lever member is detachably attached to the base at one end thereof;

a left side upper body pneumatic lever member including an adjustment member adapted to adjust a pivot point or fulcrum thereof, wherein the left side upper body pneumatic lever member is detachably attached to the base at one end thereof;

a right leg pneumatic lever member including an adjustment member adapted to adjust a pivot point or fulcrum thereof, wherein the right leg pneumatic lever member is detachably attached to the base at one end thereof;

a left leg pneumatic lever member including an adjustment member adapted to adjust a pivot point or fulcrum thereof, wherein the left leg pneumatic lever member is detachably attached to the base at one end thereof;

a pneumatic sac member including a plurality of parallel air sacs detachably attached to the right side retaining pneumatic member and to the left side retaining pneumatic member and comprising a bottom surface and a top surface, wherein the patient is positioned on the top surface, wherein the upper body lever members, the leg lever members, the at least one chest member, and the at least one lumbar back member directly engage a bottom surface of the air sac member at their corresponding positions; and a pneumatic head member including a right side chamber and a left side chamber, wherein the pneumatic head member is disposed on a top surface at a head portion of the sac member and is detactably attached to the right and left retaining pneumatic members;

(c) an inflation control assembly including at least one processing unit, a plurality of air hoses or conduits, a plurality of electrically controlled valves, a plurality of electrically controlled gas flow controllers, a plurality of fittings, and one or more electrically controlled pumps, wherein the valves, controllers, and pumps are in communication with and under control of the processing unit, wherein each of the hoses is connected to one of the fittings at a first end and one of the inflatable members at a second end, and wherein the processing unit controls an air pressure in the sac member and in each of the inflatable members, wherein one, some, or all of the inflatable members comprise multilayered constructs comprising a plurality of inflatable sections or members that give added functionality and rigidity to the inflatable members.

11. The apparatus of claim 10, wherein the control assembly further includes:

a power supply.

12. The apparatus of claim 10, wherein the control assembly further includes:

a pressure control manifold including the electrically controlled valves, the electrically controlled gas flow controllers, and the fittings.

13. The apparatus of claim 12, wherein the control assembly further includes:

an output manifold including the fittings.

14. The apparatus of claim 10, wherein the control assembly further includes:

a control panel including:

a body section having:

a plurality of light emitting diodes and/or touch sensitive areas associated with an equal plurality of body locations, a pressure control section having:

a pump in control button and/or touch sensitive area, and a pump out control button and/or a touch sensitive area, and a programming section having:

number buttons and/or touch sensitive areas, control buttons and/or touch sensitive areas, a store button and/or touch sensitive area, a recall button and/or touch sensitive area, a play button and/or touch sensitive area, a pause button and/or touch sensitive area, a stop button and/or touch sensitive area, wherein the inflation control assembly is adapted to adjust a pressure in one, some, or all of the inflatable members resulting in a bed pressure distribution corresponding to a patient bed configuration and wherein the control panel is configured to change the pressure distribution one time or according to a programmed sequence of pressure changes, to store a programmed sequence, to recall a programmed sequence, to play a programmed sequence, to pause a programmed sequence, or to stop programmed sequence.

15. The apparatus of claim 10, wherein the patient bed configuration is selected from the group consisting of a raised head position, a turned head position, a raised chest position, a turned chest position, a raised upper back position, a turned upper back position, a raised lower back or lumbar position, a turned lower back or lumbar position, a raised whole back position, a turned whole back position, a raised pelvis position, a turned pelvis position, a raised legs position, a turned legs position, a bent legs position, a turn bent legs position, and any combination of these positions.

16. The apparatus of claim 10 wherein:

the right head member chamber includes a pneumatic lever, the left head member chamber includes a pneumatic lever, the chest member includes two chambers, each of the chambers includes a pneumatic lever, and the lumbar member includes two chambers, each of the chambers includes a pneumatic lever.

17. The apparatus of claim 10, wherein:

a right leg sac portion including a plurality of right leg air sacs, and a left leg sac portion including a plurality of left leg air sacs, wherein the right pneumatic leg lever member directly contacts a bottom surface of the right leg sac portion, wherein the left pneumatic leg lever member directly contacts a bottom surface of the left leg sac portion, and wherein the patient bed configurations are selected from the group consisting of a raised head position, a turned head position, a raised chest position, a turned chest position, a raised upper back position, a turned upper back position, a raised lower back or lumbar position, a turned lower back or lumbar position, a raised whole back position, a turned whole back position, a raised pelvis position, a turned pelvis position, a raised leg position, a turned leg position, a raised legs position, a turned legs position, a bent leg position, a turned bent leg position, a bent legs position, a turn bent legs position, and any combination of these positions.

18. The apparatus of claim 10, wherein:

the inflation control assembly is configured to change the pressure in (a) the air sac member, (b) one, some, or all of the inflatable members, or (c) any combination thereof according to a programmed sequence.

19. The apparatus of claim 18, wherein the programmed sequence comprises moving patient body parts along a trajectory.

20. The apparatus of claim 19, wherein the trajectory is selected from the group consisting of raising and turning the head, raising and turning the chest, turning and lifting the whole back, raising and turning the upper back, raising and lifting the lumbar or lower back, raising and lifting the pelvis, raising and bending the legs together at the knee or at the hip, raising and bending each leg separately at the knee or at the hip, and mixtures or combinations thereof.

* * * * *